US010352048B2

(12) United States Patent
Pendley et al.

(10) Patent No.: US 10,352,048 B2
(45) Date of Patent: Jul. 16, 2019

(54) LOAD SUPPORT STRUCTURE FOR USE ON ROOF

(71) Applicant: T&M Inventions, LLC, McFarland, WI (US)

(72) Inventors: Timothy Pendley, Madera, CA (US); Michael J. McLain, McFarland, WI (US)

(73) Assignee: T&M Inventions, LLC, McFarland, WI (US)

( * ) Notice: Subject to any disclaimer, the term of this patent is extended or adjusted under 35 U.S.C. 154(b) by 0 days.

(21) Appl. No.: 15/783,565

(22) Filed: Oct. 13, 2017

(65) Prior Publication Data

US 2018/0106044 A1 Apr. 19, 2018

Related U.S. Application Data

(60) Provisional application No. 62/407,692, filed on Oct. 13, 2016.

(51) Int. Cl.
*E04D 13/03* (2006.01)
*E04D 3/30* (2006.01)

(52) U.S. Cl.
CPC ..... *E04D 13/0315* (2013.01); *E04D 3/30* (2013.01)

(58) Field of Classification Search
CPC ..... E04D 13/0315; E04D 3/30
USPC ..... 52/200
See application file for complete search history.

(56) References Cited

U.S. PATENT DOCUMENTS 853,897 A 5/1907 Porter
3,521,414 A * 7/1970 Malissa ..... E04D 13/031 285/43
3,791,088 A 2/1974 Sandow et al.
3,802,131 A 4/1974 Resech
3,828,494 A 8/1974 Uhrhane et al.
3,967,423 A 7/1976 Hammond
(Continued)

FOREIGN PATENT DOCUMENTS

GB 981948 2/1965
JP 2000-336859 5/2000
(Continued)

OTHER PUBLICATIONS

Cross-section and pictorial views of SSR-TUF-LITE daylighting panels, received Jun. 20, 2012, 1 sheet.
Cross-section of VP TUF-LITE Panel—attached to the side of SSR rib, received Jun. 20, 2012, 1 sheet.
Cross-section of Butler Lite Panel—attached to the side of MR24 rib, received Jun. 20, 2012, 1 sheet.
(Continued)

*Primary Examiner* — Brent W Herring
(74) *Attorney, Agent, or Firm* — Thomas D. Wilhelm; Stephen C. Jensen; Northwind IP Law, S.C.

(57) ABSTRACT

A roof load support structure supports a load on a sloping metal panel roof such that substantially all of the load is conveyed through rails, which are mounted on roof panel ribs, then through the roof panel ribs, and to underlying building support structure. Minor portions of the load can be conveyed through an upper diverter and a lower closure. The upper diverter diverts water laterally away from the support structure, in two opposing directions to two opposing sides of the support structure. The support structure spans at least first and second ones of the roof panels. Cut, terminal ends of an intermediate rib are cantilevered from purlins immediately above and below the support structure, and thus support middle portions of the upper diverter and the lower closure.

27 Claims, 16 Drawing Sheets

(56) References Cited

U.S. PATENT DOCUMENTS 4,117,638 A 10/1978 Kidd, Jr. et al.
4,123,883 A 11/1978 Barber, Jr. et al.
4,155,206 A 5/1979 Player
D259,812 S * 7/1981 Smith ..... D25/140
4,296,581 A 10/1981 Heckelsberg
4,470,230 A 9/1984 Weisner
4,520,604 A 6/1985 Halsey et al.
4,543,753 A 10/1985 Sonneborn et al.
4,559,753 A * 12/1985 Brueske ..... E04D 13/031 52/200
4,621,466 A 11/1986 Sonneborn et al.
4,649,680 A 3/1987 Weisner et al.
4,703,596 A 11/1987 Sandow
4,730,426 A 3/1988 Weisner et al.
4,776,141 A 10/1988 Powell
4,825,608 A 5/1989 Makin
4,848,051 A 7/1989 Weisner et al.
4,860,511 A 8/1989 Weisner et al.
4,941,300 A 7/1990 Lyons, Jr.
4,986,039 A 1/1991 Weisner
5,018,333 A 5/1991 Bruhm
5,027,576 A 7/1991 Gustavsson
5,077,943 A 1/1992 McGady
5,323,576 A 6/1994 Gumpert et al.
5,511,354 A 4/1996 Eidson
5,522,189 A 6/1996 Mortensen et al.
5,553,425 A 9/1996 Sampson et al.
5,561,953 A 10/1996 Rotter
5,647,175 A * 7/1997 Smyth ..... E04L 37/024 52/1
5,673,520 A 10/1997 Yannucci, III
5,675,940 A * 10/1997 Bahar ..... E04D 13/031 52/200
5,896,711 A * 4/1999 McClure ..... E04D 13/0315 52/198
5,960,596 A 10/1999 Lyons, Sr.
6,079,167 A 6/2000 Voegele, Jr.
D431,174 S 9/2000 Merideth
6,151,838 A * 11/2000 Husein ..... E04D 13/02 52/200
D448,095 S 9/2001 Merideth
6,640,508 B2 11/2003 Lindgren et al.
6,715,237 B2 4/2004 Batt, Sr.
6,775,951 B2 8/2004 Gumpert et al.
6,966,157 B1 11/2005 Sandow
7,043,882 B2 5/2006 Gumpert et al.
7,263,807 B2 9/2007 Gumpert
7,296,388 B2 11/2007 Valentz et al.
7,308,777 B2 12/2007 Sandow
7,395,636 B2 7/2008 Blomberg
7,712,279 B2 5/2010 McClure
7,721,493 B2 5/2010 Skov et al.
7,736,014 B2 6/2010 Blomberg
8,028,478 B2 10/2011 Valentz et al.
8,438,798 B2 * 5/2013 McLain ..... E04D 3/364 52/200
8,438,799 B2 * 5/2013 McLain ..... E04D 3/364 52/200
8,438,800 B2 5/2013 McLain et al.
8,438,801 B2 5/2013 McLain et al.
8,448,393 B2 5/2013 Voegele et al.
8,561,364 B2 10/2013 Pendley et al.
8,567,136 B2 10/2013 Pendley et al.
8,763,324 B2 7/2014 Pendley et al.
8,833,009 B2 9/2014 Pendley et al.
8,844,216 B2 9/2014 Pendley et al.
9,027,291 B2 5/2015 Pendley et al.
9,032,671 B1 * 5/2015 Pendley ..... E04D 13/0481 52/97
9,127,461 B2 * 9/2015 Pendley ..... E04D 3/352
9,151,057 B2 * 10/2015 Mills ..... E04D 13/1475
9,316,000 B2 * 4/2016 Pendley ..... E04D 13/031
9,534,390 B2 * 1/2017 Pendley ..... E04D 13/031
9,546,485 B2 * 1/2017 Mills ..... E04D 13/1475
9,637,927 B2 5/2017 Pendley et al.
2002/0026756 A1 3/2002 Gumpert et al.
2004/0049996 A1 3/2004 Blomberg
2005/0016090 A1 1/2005 Gumpert et al.
2005/0204674 A1 9/2005 Marshall
2006/0070315 A1 * 4/2006 McClure ..... E04D 13/0315 52/200
2006/0191230 A1 8/2006 Gumpert
2007/0094984 A1 5/2007 McClure
2007/0101665 A1 5/2007 Sandow
2008/0040993 A1 2/2008 Valentz et al.
2008/0190050 A1 8/2008 McClure
2010/0162643 A1 7/2010 Blomberg et al.
2010/0269426 A1 10/2010 Richter et al.
2011/0154751 A1 6/2011 Gumpert
2011/0252726 A1 10/2011 McLain et al.
2011/0252727 A1 10/2011 McLain et al.
2012/0233941 A1 9/2012 McLain et al.
2012/0233942 A1 9/2012 McLain et al.
2013/0031855 A1 2/2013 Blomberg et al.
2013/0167459 A1 7/2013 Pendley et al.
2013/0219825 A1 8/2013 Pendley et al.
2013/0239489 A1 9/2013 Pendley et al.
2013/0239500 A1 9/2013 Pendley et al.
2013/0239513 A1 9/2013 Pendley et al.
2014/0020314 A1 1/2014 Pendley et al.
2014/0109497 A1 4/2014 Pendley et al.
2014/0260068 A1 * 9/2014 Pendley ..... E04D 13/031 52/710
2014/0373463 A1 12/2014 Pendley et al.
2015/0013241 A1 1/2015 Pendley et al.
2015/0013247 A1 * 1/2015 Pendley ..... E04D 3/352 52/200
2015/0013248 A1 * 1/2015 Pendley ..... E04D 3/352 52/200
2015/0121773 A1 * 5/2015 Mills ..... E04D 13/1475 52/58
2015/0315792 A1 * 11/2015 Pendley ..... E04D 13/0481 52/745.15
2016/0024798 A1 * 1/2016 Mills ..... E04D 13/1475 52/302.1

FOREIGN PATENT DOCUMENTS

JP 2001-214577 8/2001
JP 2008-202372 9/2008
WO WO 2010/040006 4/2010

OTHER PUBLICATIONS

FAA Facility, photos of skylight installation, 3 pages, Sacramento, CA, prior to 2007.
Siemens Building, photos of skylight installation, 6 pages, prior to 2007.
R & S Manufacturing and Sales Company, Inc., Standing Seam 24 Light, Quick Installation Instructions, Under/Over Seam Clip, 12 pages, Newbury Park, CA, Aug. 2012.
R & S Manufacturing and Sales Company, Inc., SS 24 Light, The First Truely Thermally Broken Metal Building Skylight, informational sheet, 1 page, Newbury Park, CA, Aug. 2012.
R & S Manufacturing and Sales Company, Inc., Enlarged sketch of metal roof showing the down slope, 1 page, Newbury Park, CA, Aug. 2012.
Daljcon, LLC., Butler Manufacturing, www.daljcon.com, Example of 6 Layer Standing Seam, printed Dec. 11, 2012.

* cited by examiner

LOAD SUPPORT STRUCTURE FOR USE ON ROOF

CROSS-REFERENCE TO RELATED APPLICATION

This application claims priority under 35 U.S.C. § 119(e) to provisional patent application U.S. Ser. No. 62/407,692, "Load Support Structure For Use on Roof", filed Oct. 13, 2016, the contents of which are incorporated herein by reference.

BACKGROUND OF THE INVENTION

Various systems are known for supporting loads on roofs, and for installing skylights and/or smoke vents onto, or into, roofs.

A significant motivation for use of skylights is that the daylighting which enters the building through the skylight lenses can reduce or eliminate the need for use of electrical light fixtures during the daylight hours. Further, conventionally-known control systems can monitor the light intensity at desired, selected locations inside the building and automatically turn on selected ones of the electrical light fixtures as needed in order to maintain a desired level of light intensity at the selected locations inside the building, or selectively dim, or turn off, such light fixtures when a desired level of light intensity is being delivered through the skylights.

The benefits of using skylights to obtain daylighting include lower energy costs, less use of fossil fuels for generating electricity, and potentially less worker stress or fatigue. A significant problem associated with use of many conventionally-available skylight lens assemblies is that many conventionally-available skylight lens assemblies are known to have high probability of leaking during rain events.

Commonly used skylighting systems have translucent or transparent covers, also known as lenses, mounted on a support structure, commonly known as a "curb", which is mounted to building support members inside the building and wherein such support structure extends through an opening in the roof. Ambient daylight passes through the lens and thence through the roof opening and into the building.

Thus, such conventional skylight and smoke vent installations use a curb structure beneath the exterior roofing panels and inside the building enclosure, and extending through the roof structure, in order to provide a support which extends through the roof, past the roof panels, and which supports the skylight lens assembly. Conventional such skylight curbs, thus, are generally in the form of a preassembled box-like structure. Such box-like structure is mounted to building framing members inside the building enclosure, and extends through a respective opening in the roof, and past the respective elongate metal roof panels. Such skylight assembly thus mounts inside the building enclosure, and extends through an opening in a corresponding roof structure. Fitting skylight assemblies into such roof openings presents problems, both for the installer and for the user. A primary problem is that mentioned above, namely that curb-based types of installations of conventional skylight support structures have a tendency to leak water when subjected to rain.

In light of the leakage issues, there is a need for a more effective way to support skylights and smoke vents, thus to bring daylighting into buildings, as well as a more effective way to support a variety of other loads, on roofs.

To achieve desired levels of daylighting, curb-based skylight installations use multiple roof openings spaced regularly about the length and width of a given roof surface through which daylighting is to be received. Each skylight lens is installed over a separate such opening.

In recent developments by the inventors herein, skylight support structures are mounted on the metal roof panels of standing seam roofs, thus to take advantage of the beam strength in the ribs. Various aspects of these developments are disclosed in U.S. Pat. No. 8,438,798 (McLain et al.), U.S. Pat. No. 8,438,799 (McLain et al.), U.S. Pat. No. 8,438,800 (McLain et al.), U.S. Pat. No. 8,438,801 (McLain et al.), U.S. Pat. No. 8,561,364 (Pendley et al.), U.S. Pat. No. 8,567,136 (Pendley et al.), U.S. Pat. No. 8,763,324 (Pendley et al.), U.S. Pat. No. 8,833,009 (Pendley et al.), U.S. Pat. No. 8,844,216 (Pendley et al.), and U.S. Pat. No. 9,441,377 (Pendley et al.), each of which is incorporated herein by reference in its entirety.

In the above patents, the skylight assemblies are raised above elongate panel flats which extend the lengths of the roof panels, whereby rib elements at the sides of adjacent such roof panels are joined to each other in elongate joinders, referred to as the ribs.

The opening for a conventional curb-mounted skylight cuts across multiple such ribs in order to provide a wide enough opening to receive conventionally-available commercial-grade skylight assemblies. Such curb-mounted skylight assembly, itself, includes a curb which is mounted inside the building and extends, from inside the building, through the roof opening and about the perimeter of the opening, thus to support the skylight lens above the flats of the roof panels, as well as above the ribs. Flashing, and conventional pliable tube construction sealants, are applied about the perimeter of the roof opening, between the roof panels and the flashing, including at the cut ribs. Typically, substantially all of such sealant is applied in the panel flats, which means that such sealant is a primary barrier to water leakage about substantially the entire perimeter of the skylight curb.

One of the causes of roof leaks around the perimeter of curb-mounted skylights which attach primarily through the panel flat at the water line is due to foot traffic, such as heel loads or other dynamic loads imposed by workers wheeling gas cylinders or other heavy equipment on the roof panel e.g. with dollies. This type of dynamic loading can cause high levels of stress and/or flexing of the roof panels adjacent the edges of the curb. Such joints between the roof panels and the curb typically rely solely on flashing and tube sealant to provide seals between the curb and the roof panels, most notably in the panel flats. Leaks are also commonly attributed to areas around fastener locations, as the panels flex under load, causing stress between the sealant and the respective curb and/or roof panels; whereby the sealant deforms such that, with repeated flexing of the sealant over time, passages develop through the sealant, which allows for the flow of water through such passages and into the building.

Such curbs, each extending through a separate roof opening, each sealed largely in the panel flats, create multiple opportunities for water to enter the interior of the building. Such opportunities include, without limitation, (i) the number of individual openings in the roof,
(ii) the tendency of water to collect and stay at the upper end of the curb,
(iii) the disparate expansion and contraction of the roof panels relative to the skylight-supporting curb,
(iv) the lengths of sealed seams in the panel flats, and (v) flexing of tube sealant pursuant to localized loads being exerted on roof panels adjacent a such skylight or other opening.

Traditional curb constructions and methods of attachment in most cases thus require that a complex support structure be installed below the metal roof panels and supported from building framing structure, such as purlins, located inside the building enclosure, which allows disparate/discordant movement of the metal roof panels and the skylight assembly relative to each other, as associated with thermal expansion and contraction of the metal roof e.g. in response to differences in temperature changes outside the building relative to contemporaneous temperatures inside the building.

In addition, conventional curb-mounted skylight structures tend to collect condensation on inside surfaces of the heated space in the building.

In the teachings of the above patents, the skylight support assemblies are illustrated as being mounted on adjacent ones of the roof ribs. Insulation from where the skylight opening is cut in the roof is raised up alongside the respective ribs and upstanding support elements of the support structure, in order to provide a thermal break along the sides and ends of the support structure, as well as to attenuate water vapor condensation on inside surfaces of the support structure.

While commercial versions of support structures on roofs based on the above patents have found substantial success in the commercial marketplace, a concession in the commercial versions of such support structures is that such support structures have been produced only in embodiments which span a single roof panel, and are thus limited to less than the 24-inch width of such roof panels.

However, customers for such buildings are familiar with the older style curb-mounted skylights which typically span at least 2 roof panels, and are thus up to about 48 inches wide. While the up to 24-inch wide roof-mounted panels available so far, each 10 feet long, can be mounted end to end over a single roof aperture in order to provide a relatively elongate skylight opening, customers continue to prefer a skylight structure having a nominal width of up to 48 inches.

Thus it would be desirable to provide a roof-mounted load support structure which has the benefits of using the beam strength of the standing seam and the rib, while having a width spanning at least two 24-inch wide roof panels, and which avoids leaks by being mounted on the roof, rather than extending up through the skylight aperture from mountings at the underlying building support structure in the climate controlled space inside the building.

It would further be desirable to provide a roof-mounted load support structure where skylight lenses, spanning at least two 24-inch wide roof panels, can be mounted end to end over a single roof aperture.

It would be still further desirable to provide such a roof-mounted load support structure which directs water, approaching the support structure from up-slope, to panel flats of first and second roof panels on opposing sides of the support structure.

SUMMARY OF THE INVENTION

The invention provides a construction system for installing loads, such as skylight assemblies and/or smoke vent assemblies, or other loads, where all of the load is transferred through the roof panels to which the support structure is mounted, to underlying building support structure. And almost all of the load is transferred through the roof panel ribs to which the support structure is directly mounted. The portions of the load which bear on the central portion of the upper diverter and the lower closure transfer through respective upper and lower support ribs of the roof panels, which support ribs are spaced from left and right sides of the support structure, and which extend to substantially the edge of the skylight aperture/opening. The upper and lower support ribs are cantilevered extensions of such ribs, extending short cantilevered distances from adjacent purlins, and accordingly effectively provide support central portions of the upper diverter and the lower closure by functioning as cantilever beams, transferring the central portions of the overlying load to the adjacent purlins.

As used herein "beam strength" refers to the capability of a structural element to resist a bending force, as "beam strength" is defined at www.wikipedia.org. Within this context, the folded over, and crimped, standing seams on the ribs, in a standing seam metal panel roof, acting in a capacity as beam web structure, provide beam-like strength in supporting/resisting the weight of overlying vertical loads imposed on the roof.

In addition, as will be seen in the drawings herein, generally-horizontally extending, laterally-directed panels of a rib extend generally perpendicular to the upstanding standing seam structure of a given rib. Lower shoulders of the rails rest on, and are directly supported by, these generally horizontally-extending rib panels.

And while the illustrations and embodiments revealed herein show water diverted to opposing sides of the support structure at the upper diverter, it is possible, though less efficient, to provide similar structure whereby the water is all diverted to a single side of the support structure.

In a first family of embodiments, the invention comprehends a support structure configured to support an overlying load on a metal panel roof defined by a plurality of metal roof panels extending from an eave to a ridge, where the support structure includes a first rail structure, a second rail structure, an upper diverter, and a lower closure. The first rail structure may form a first side of the support structure, and the second rail structure may form a second side of the support structure. The first and second rail structures also may extend from a relatively upper portion of the support structure, at a relatively upper portion of the roof, toward a relatively lower portion of the support structure, at a relatively lower portion of the roof. The upper diverter may extend across at least first and second such roof panels and terminate at the first and second rail structures. The upper diverter may also extend across a middle rib, to which the upper diverter may be mounted. The lower closure may extend across the first and second roof panels and terminate at the first and second rail structures. The lower closure may also extend across the middle rib, to which the lower closure may be mounted.

BRIEF DESCRIPTION OF THE DRAWINGS

A more complete understanding of the present invention and the attendant features and advantages thereof may be had by reference to the following detailed description when considered in combination with the accompanying drawings, which depict, among other things, various components and compositions of support structures of the invention.

Figure 1:
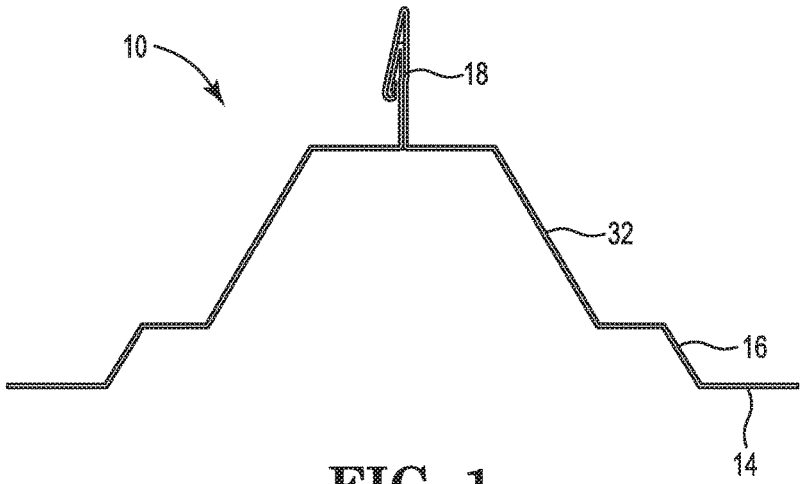
FIG. 1 is a profile of a portion of a metal roof of the type known as a standing seam roof.

This invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF ILLUSTRATIVE EMBODIMENTS

The products and methods of the present invention provide a load support structure, for use in installing and supporting various exterior roof loads, including structures which close off openings in standing seam metal panel roofs. For purposes of simplicity, "support structure" is used interchangeably herein to refer to various types of structures which are mounted on ribs of raised-elevation metal panel roof structures, such that substantially all of the load passes through the support structure and through the ribs on which the support structure is mounted, to the underlying building framing inside the building. The support structure surrounds an opening in the roof, including extending across the flats of at least two roof panels. Skylight assemblies and smoke vents are non-limiting examples of loads which are mounted on such support structures and which extend over, and close off, such roof openings. Air handling operations such as vents, air intakes, and air or other gaseous exchanges to and/or from the interior of the building are non-limiting examples of operations where conduits extend through the roof opening. In the case of roof ventilation, examples include simple ventilation openings, such as, for example and without limitation, roof fans, and smoke vents which are used to allow the escape of smoke through the roof during a fire. The only limitation regarding the loads to be supported is that the magnitude of a load must be within the load-bearing capacity of the roof assembly to which the load is mounted.

The number of skylights or other roof loads can vary from one load, to as many loads as the building roof can support, limited only by the amount of support which the respective roof panels, namely the ribs to which the rails are attached, can provide.

The invention provides structures and installation processes, as support systems which utilize the beam-like bending resistance of the standing seams, as well as utilizing the strength inherent in the upstanding panels of the ribs, as primary support, supporting e.g. a downwardly-directed load.

Support structures of the invention are not mounted directly to the building framing inside the climate-controlled building enclosure for the purpose of being themselves supported, and thereby supporting, an installed skylight system or other load. Neither does the skylight system of the invention require a separate structure surrounding each skylight lens assembly to separately support or mount or attach each skylight lens assembly to the roof. Rather, a support structure of the invention, which supports such skylights, is overlaid onto, and mounted to, the respective roof panels, thus exposing the support structure to the same ambient weather conditions as the weather conditions which the surrounding roof panels experience. Accordingly, the support structure experiences approximately the same, or a similar, rate of thermal expansion and contraction as is experienced by the respective roof panels to which the support structure is mounted. Such similar expansion and contraction is accomplished through direct attachment of the support structure of the invention, which supports e.g. a skylight assembly or other load, to the underlying metal roof panels. According to such roof mounting, the support structure is exposed to the same e.g. ambient temperatures as the roof panels, whereby expansion and contraction of the support structure of the invention generally coincides with concurrent expansion and contraction of the metal roof panels.

Referring now to the drawings, a given metal roof panel generally extends from the peak of the roof to the respective eave. Skylight systems of the invention can amount to a single skylight lens assembly over a roof opening or multiple skylight lens assemblies, end-to-end, over a single roof opening which extends along the major rib structures of at least first and second next adjacent such metal roof panels on the building. Thus, multiple skylight assemblies can be installed in strips over a continuous, uninterrupted opening in the metal roof. Such opening extends along a line which can extend from at or near the roof ridge, contained within a single line of two or more roof panels from end to end of the opening, to a location at or near a corresponding eave. In the alternative, a first number of individual skylight assemblies can be installed, individually, over a corresponding number of roof apertures, where each roof aperture underlies a single skylight assembly.

A first, up-slope skylight assembly over a given roof opening is 9 feet long, so as to fit between two roof purlins, with a third intermediate purlin extending under the opening. Second and subsequent skylight assemblies, end-to-end with the first skylight assembly and with each other, are 10 feet long. Accordingly, the last down-slope skylight assembly, and thus the lower end of the roof opening, is up-slope of an adjacent purlin by about 4 inches, such that the down-slope end of the support structure is supported by a cantilevered portion of the middle rib 32C.

Skylight systems of the invention can be applied to various types of ribbed roof profiles. FIG. 1 is an end view showing a roof profile of a metal roof of the type known as a standing seam roof. These include the "standing seam" roof, which has trapezoidal elevated elongate major ribs 32 typically 24 inches to 30 inches on center. Each roof panel 10 also includes a panel flat 14, and may include a rib shoulder 16 as part of a rib 32, next to the panel flat. The elevated rib structures on a given panel cooperate with corresponding elevated elongate rib structures on next-adjacent panels, thus forming standing seams 18. Seams 18 represent the edges of adjacent such roof panels, folded one over the other, and crimped, to form elongate joinders at the side edges of the respective roof panels. In the process of forming the standing seams, the edge regions of the rib elevations on respective adjacent panels are, together, folded over such that the standing seam functions as a folded-over raised joinder between the respective panels, thus to inhibit water penetration of the roof at the standing seam/joint.

Figure 2:
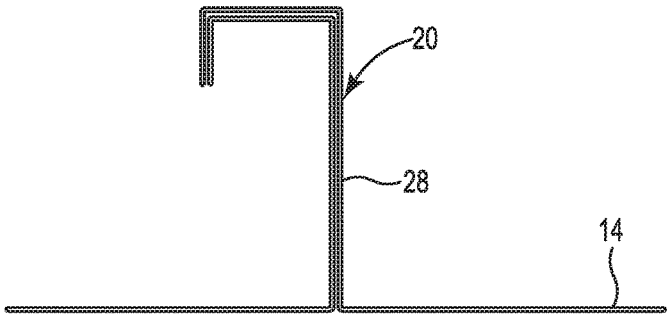
FIG. 2 is a profile of a portion of a metal roof of the type known as an architectural standing seam roof.

FIG. 2 is an end view showing the roof profile of a metal roof of the type known as an architectural standing seam roof, which uses a series of overlapping architectural standing seam panels 20. Each panel 20 comprises a panel flat 14, and a rib element of an architectural standing seam 28 on each side of the panel.

Figure 3:
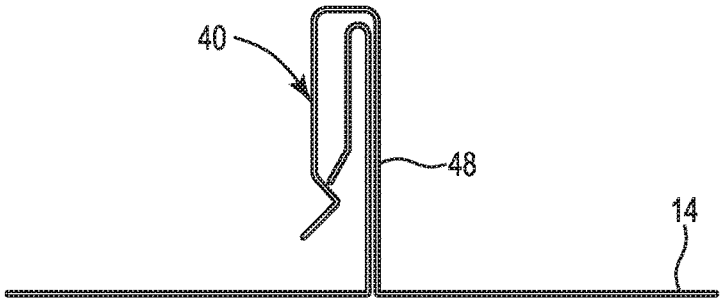
FIG. 3 is a roof profile of a portion of a metal roof of the type commonly referred to as a snap seam roof.

FIG. 3 is an end view showing the roof profile of a metal roof of the type commonly referred to as a snap rib seam panel 40. Snap rib seam panels 40 have a panel flat 14 and a standing seam, also known as a snap seam 48, where the adjacent panels meet.

A skylight/ventilation support structure is illustrative of support structures of the invention which close off roof-penetrating openings. Such support structure can comprise a rail and closure support structure which surrounds an opening in the roof, and which is adapted to be mounted on, and supported by, the prominent standing elevations, standing rib structures, standing seams, or other upstanding elements of conventional such roof panels, where the upstanding structures of the roof panels provide the primary support for the so-mounted support structures. Namely, structure which is mounted to the roof panels above the panel flats, e.g. at seams/joints/ribs where adjoining metal roof panels are joined to each other, provides the primary support for supporting respective loads. Such a rail and closure support structure is secured to the conventional metal roof panels by fasteners located above the respective panel flats. Such support structure surrounds an opening in the roof, the opening extending along the lengths of the respective roof panels, and between first and second ribs on adjacent at least first and second ones of the roof panels.

Figure 4:
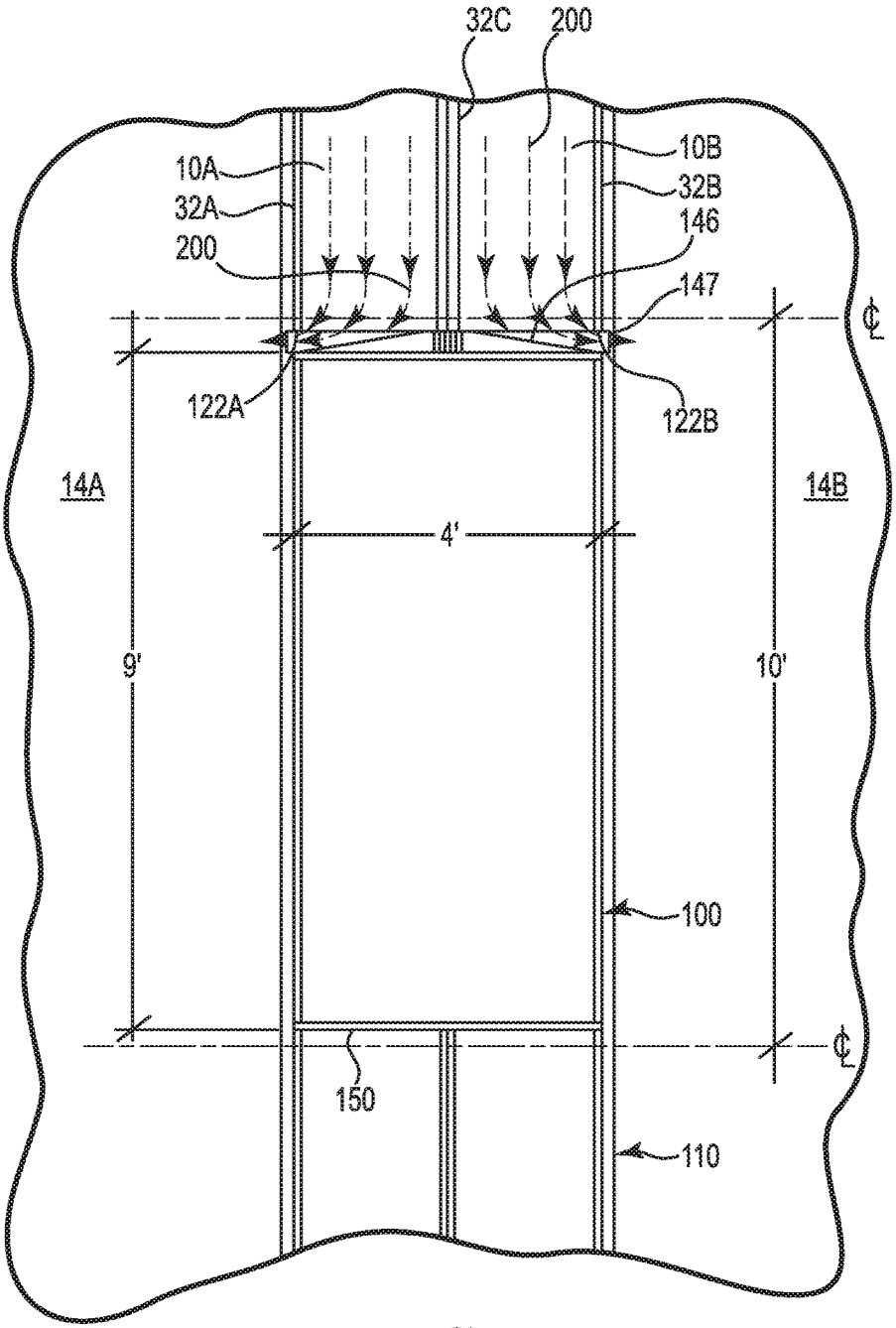
FIG. 4 is a plan view of a support structure of the invention spanning the widths of first and second roof panels.

FIG. 4 is a top/plan view of a single support structure 110 of the invention mounted across the widths of first and second roof panels 10A, 10B.

Figure 11:
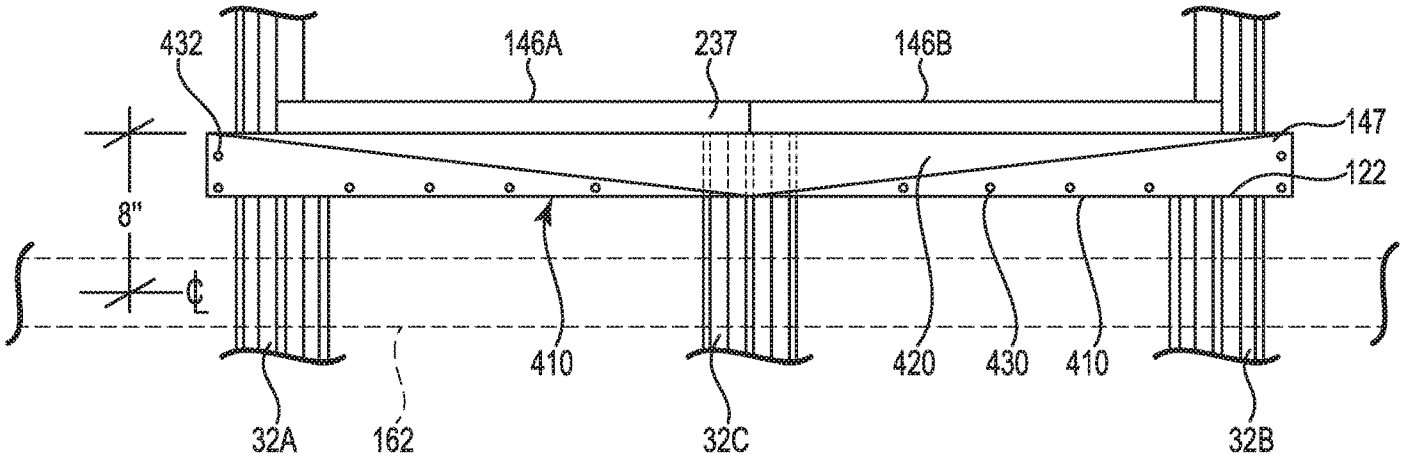
FIG. 11 shows a plan view of an up-slope portion of a support structure of the invention, illustrating especially the upper diverter, and the spacing between the aperture opening, the supporting purlin up-slope of the diverter, and the cantilevering, from the purlin, of the rib which supports the central portion of the upper diverter load.

As seen in FIGS. 4 and 11, the support structure is 9 feet long, and thus fits between two roof purlins 162. The up-slope end of the roof opening starts about 8 inches down slope from the up-slope purlin. The down-slope end of the roof opening ends 4 inches up-slope of the down-slope purlin. The middle rib 32C extends to both the up-slope and down-slope ends of the opening, whereby the beam-strength support capabilities of the middle rib are cantilevered from the respective purlins to the upper and lower edges of the roof opening.

If the roof opening is extended longer than the 9 foot opening shown, the opening is extended in 10 foot increments corresponding to the respective 10 foot spacings between the purlins. However many such 10 foot increments are used, the down-slope end of the roof opening is always 4 inches up-slope from a purlin or eave, thus to capture support from the respective purlin or eave. The 9 foot opening can, of course, be 4 feet, thus to span only two purlins, and capture the cantilevered support from those purlins at the upper diverter and lower closure. Similarly, the 10 foot increments can be 5 foot increments, thus to span only two purlins and capture the cantilevered support from those purlins at the upper diverter and lower closure.

Figure 5:
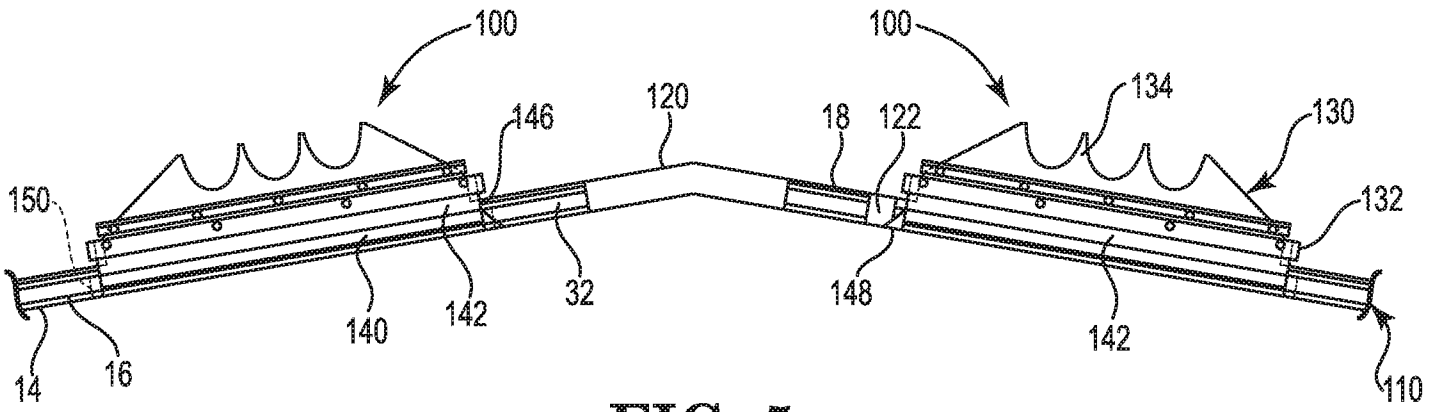
FIG. 5 is a side view showing major components of a relatively shorter embodiment of first and second skylight assemblies using support structures of the invention, installed on opposing sides of the ridge of a standing seam metal roof.

FIG. 5 shows first and second exemplary support structures 100, mounted to a standing seam panel roof 110, and overlain by loads defined by first and second skylight lens assemblies 130.

Figure 6:
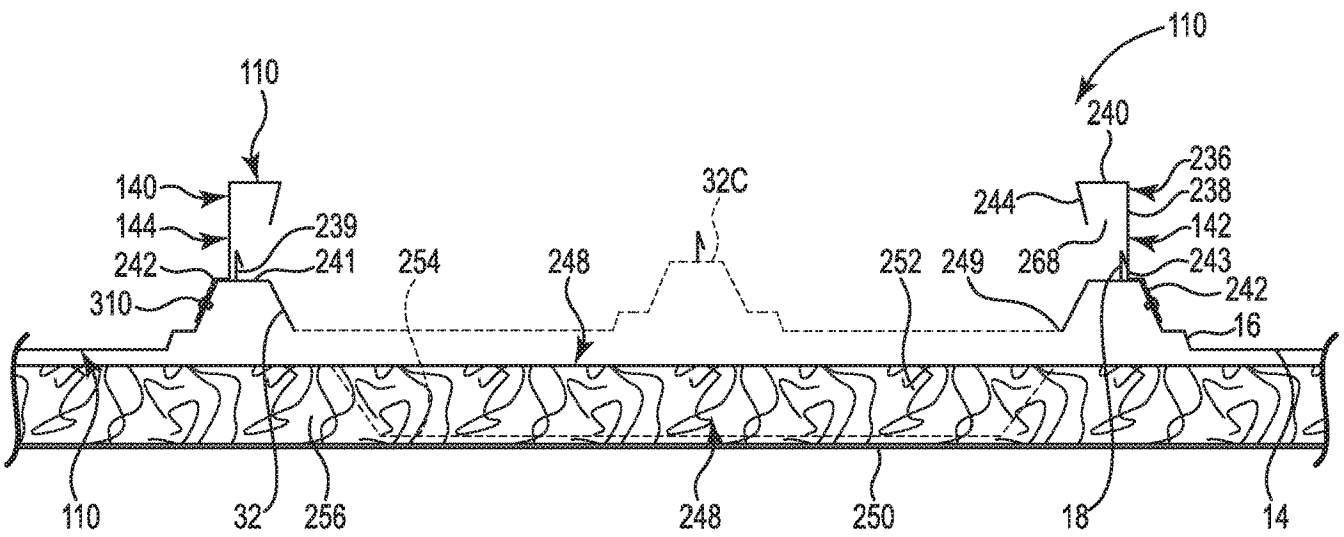
FIG. 6 is a cross sectional view showing the relationships of the rails to the rib elevations of a standing seam metal panel roof where the panel flats have been removed, including showing underlying building insulation.

FIG. 6 shows a portion of the roof 110 of FIGS. 4 and 5, in dashed outline. The roof has raised ribs 32, panel flats 14, shoulders 16 and standing seams 18. Given that water seeks the lowest level available at any given location, any water on a given roof panel tends to congregate/gather on the upper surface of the panel flat whereby, except for any dams across the panel flat, the water line is generally limited to the panel flat and slightly above the panel flat, depending on the quantity of water on the panel flat and the rate at which rain is falling or water is otherwise accumulating on the roof. Thus, at any given time, most of shoulder 16, and all of rib 32 above shoulder 16, and all of standing seam 18, are all typically above the top surface of the water, colloquially known as the water line. Also depicted in FIG. 5 is ridge cap 120 of the roof structure. A cutaway region, or gap 122 is shown in FIG. 5, extending through one of the respective raised ribs 32. FIG. 4 shows first 122A and second 122B gaps through respective raised ribs 32A, 32B on opposing sides of the support structure.

Skylight lens assembly 130, which is part of the closure system for closing off the aperture, generally comprises a skylight lens frame 132 mounted to the load support structure and extending about the perimeter of a given load support structure, in combination with a light-transmitting skylight lens 134 mounted to frame 132. An exemplary such skylight lens is that taught in U.S. Pat. No. 7,395,636 (Blomberg) and available from Sunoptics Prismatic Skylights, Sacramento, Calif.

Still referring to FIGS. 4 and 5, support structure 100 of the invention, as applied to a skylight installation, is provided by an assembly which includes first and second side rails 142, 144, an upper diverter 146, and a lower closure 150. Such support structure includes one or more first side rails 142 and one or more second side rails 144, an upper diverter 146 disposed adjacent rib gaps 122, and a lower closure 150.

Figure 15:
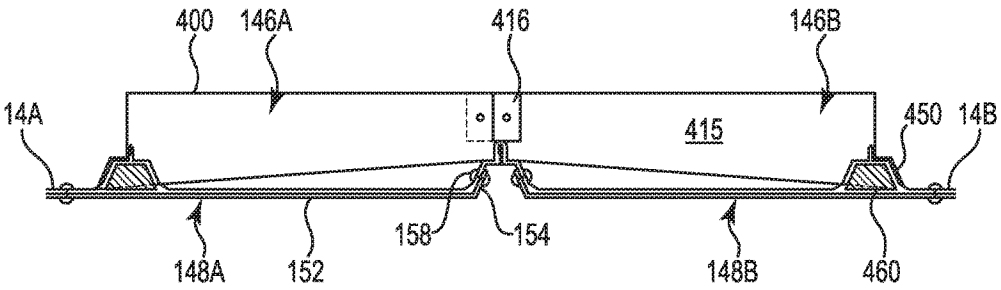
FIG. 15 is an elevation view, looking in a down-slope direction, of an upper diverter assembly of the invention mounted on a standing seam metal roof.

As shown in FIG. 4, lateral legs 147 of the upper diverter extend through left and right gaps 122, providing water-conveying bottom surfaces of the diverter across the gaps. Referring to FIGS. 11 and 15, lateral legs 147 include those portions of the lower flanges 410, diversion surfaces 420, and upstanding webs 415 (as rib sealing portions 450), which extend through gaps 122 in the respective ribs. The diverter thus carries water laterally through the gaps, across the widths of the respective ribs, to the panel flats 14A, 14B of the adjacent roof panels on opposing sides of the support structure, thus to convey the water away from the upper end of the skylight and to prevent the water from entering the roof aperture. Rail and closure structure 140 also includes stiffener plates 148, and rubber or plastic plugs 460 to support the upper diverter and lower closure, and to close off the cut ends of ribs 32A, 32B at gaps 122A, 122B. Stiffener plates 148 provide dimensional support and screw reception at the panel flats. Plugs 460 close gaps/spaces under ribs 32 at gaps 122.

FIG. 4 shows how gaps 122A, 122B in ribs 32A, 32B, in combination with upper diverter 146, provides for water flow, as illustrated by arrows 200, causing the water to move laterally along the roof surface, over lateral legs 147 of the left and right segments of the upper diverter, and downwardly on panel flats 14 of the roof panels which are next adjacent the gaps 122.

Referring now to FIG. 6, a cross section through ribs 32A, 32B, and 32C, and associated support structure 100 shows securement of support structure 100 to standing rib portions of the standing seam panel roof 110. FIG. 6 depicts the use of ribs 32A, 32B to support side rails 142 and 144 on opposing sides of the support structure. Each rail 142 or 144 has a lower rail shoulder 242 and a rail upper support structure 236. Rail upper support structure 236 has a generally vertically upstanding outer web 238, a generally horizontal rail upper flange or bearing panel 240, and a rail inside panel 244. Inside panel 244 extends toward outer web 238 at an included angle, more or less, of about 75 degrees between upper flange 240 and panel 244. From web 238, shoulder 242 extends laterally at a perpendicular angle over the respective rib 32 as a shoulder top, and turns at an obtuse included angle down, tracking the sloped angle of the side of the respective rib 32. The rail is secured to the side of rib 32 by mechanical fasteners 310, such as rivets or screws, spaced along the length of the rib and above the adjacent panel flat, thus securing the lower shoulder of the rail to the side of the rib. The weight of the support structure, and the overlying carried load, bears on the shoulder top.

Figure 7:
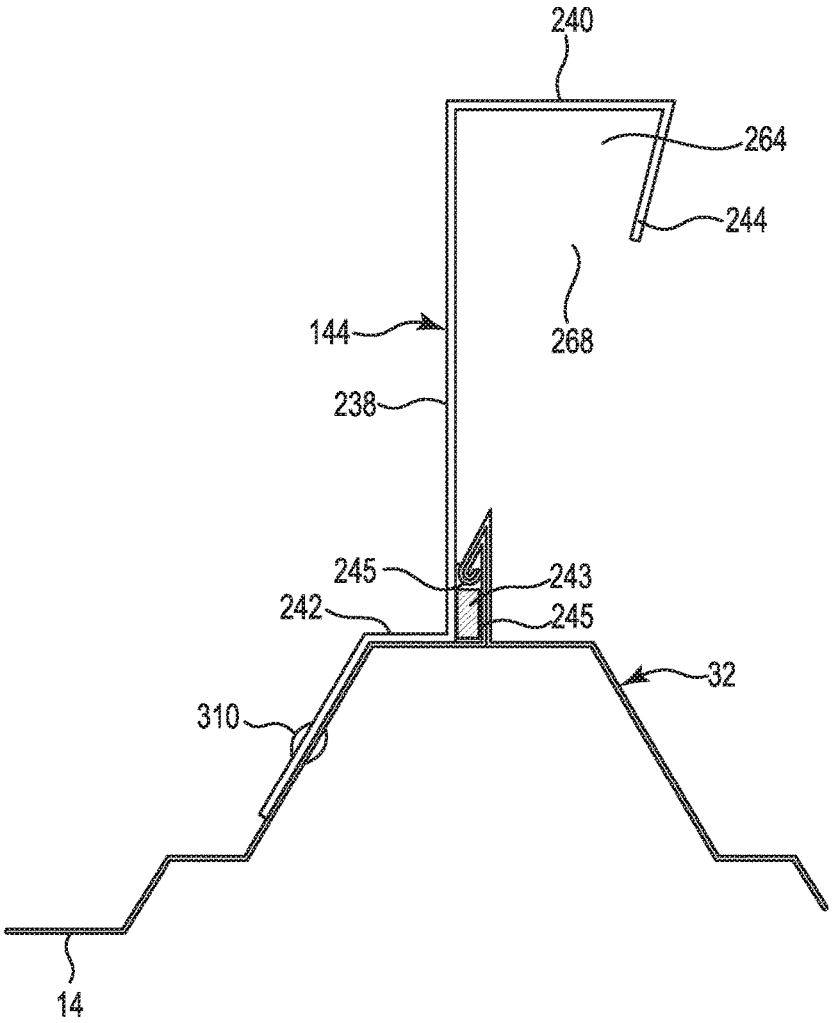
FIG. 7 is an enlarged end view of a rail mounted on a rib, illustrating a gap plug in the space between the upstanding web of the rail and the standing seam of the metal roof, under the turned-over edges of the standing seam.

As illustrated in FIGS. 1, 6, and 7, in the joinder of each pair of adjacent panels, the edges of the two roof panels are folded together, one over the other, and crimped together, leaving a space 239 between the bottom edges of the folded over panel edges and the underlying top flat surface of top panel 241 of the rib. Where the space 239 faces web 238 of the rail, as at the right side of FIG. 6, and as shown in FIG. 7, a gap plug 243 is disposed in space 239 between the standing seam and upstanding outer web 238 of the rail, and under the turned-over edges of the panels. Gap plugs 243 are used both where the upper diverter meets the side rails and where the lower closure meets the side rails.

Where space 239 faces away from upstanding outer web 238 of the side rail, as at the left side of FIG. 6, the flat surface of upstanding outer web 238 can be brought into a close enough relationship with the standing seam that any space between the standing seam and the upstanding web can be closed by pliable tube sealants. Thus, no gap plug is typically used between upstanding outer web 238 and the standing seam where the distal edge of the crimped seam is turned away from the upstanding web.

Gap plug 243 is relatively short, for example about 1.5 inches to about 2.5 inches long, and has a width/height cross-section, shown in FIG. 7, which loosely fills space 239. The remainder of the space 239, about plug 243, namely between plug 243 and upstanding outer web 238, and between plug 243 and the standing seam, is filled with e.g. a pliable construction sealant 245. Such sealant is shown in FIG. 7 as white space about plug 243. Plug 243 thus provides a solid fill piece at spaces 239 where there is, otherwise, some risk of water entry into the roof opening, and where the space 239 is too large for assurance that a more pliable e.g. tube sealant can prevent such water entry.

Gap plug 243 is made of a relatively solid, yet resilient material, e.g. EPDM (ethylene propylene diene monomer) rubber, which provides relatively solid e.g. relatively non-pliable mass in space 239 between the folded-over standing seam and upstanding outer web 238 of the rail, and relatively pliable, putty-like, tape mastic and tube caulk or the like are used to fill the relatively smaller spaces which remain after the gap plug has been inserted in the respective gap/space.

Figure 10:
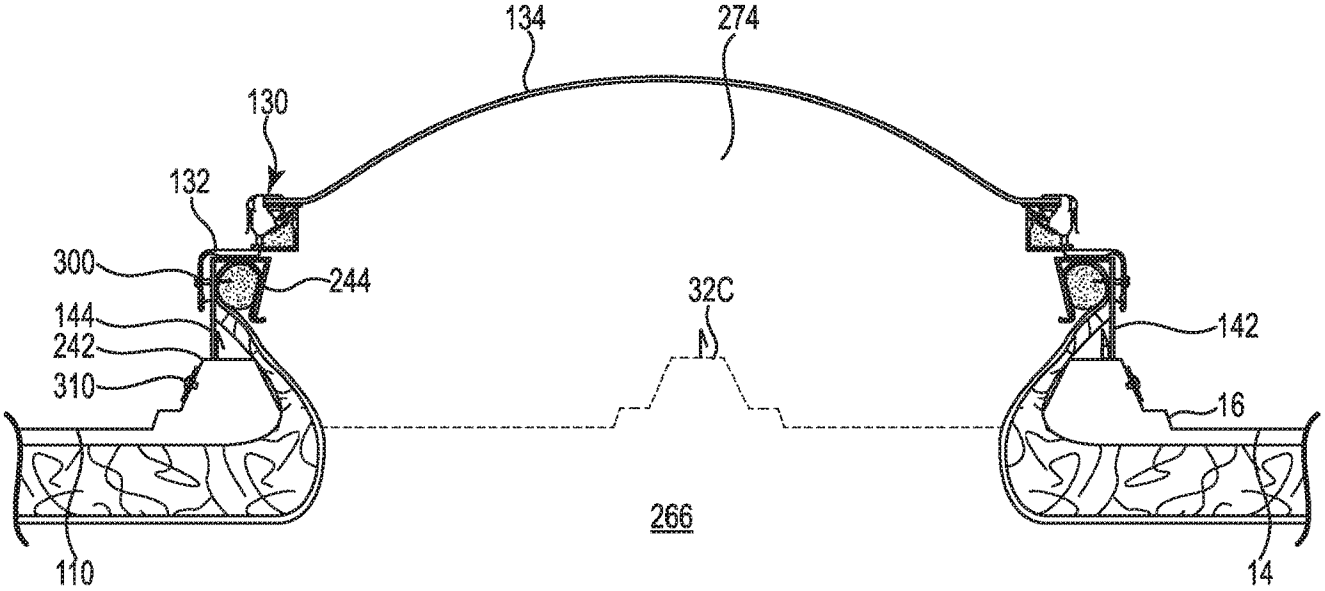
FIG. 10 shows a cross-section as in FIGS. 6, 8, and 9 where the insulation underlying the roof has been extended up through the aperture in the roof, where the vapor barrier layer on both sides of the opening has been tucked into the rail cavity and is being held in the cavity by retainer rods such as that shown in FIG. 9, and where the skylight lens assembly has been mounted to the rails, and serves as a cover/closure over the aperture in the metal roof.

Upper flange 240, at the top of the rail, is adapted to support skylight frame 132, seen in FIG. 10. Inside panel 244 of the rail extends down from the inner edge of upper flange 240 at an acute included angle, illustrated at about 75 degrees.

Referring back to FIG. 6, insulation 248 is shown below the opening 249 in the metal panel roof. Insulation 248 has a facing sheet/vapor barrier layer 250 underlying a layer of thermally-insulating, e.g. fiberglass, batt material 252. Dashed line 254 outlines the approximate portion of the fiberglass batt material which is to be removed. An edge portion 256 of batt material is left extending into opening 249 for use described hereinafter.

Rail and closure structure 140 is representative of the perimeter portion of support structure 100. Rails 142, 144 fit closely along the contours of ribs 32. Upper diverter 146 and lower closure 150 have collective contours which match the cross-panel contours of respective ones of ribs 32 as well as matching the respective panel flats 14. The various mating surfaces of rail and closure structure 140 and roof 110 can be sealed in various ways known to the roofing art, including caulk and/or tape mastic. Plastic or rubber fittings or inserts such as plugs 243, and plugs 460 can be used to fill larger openings at the rails and ribs.

Figure 8:
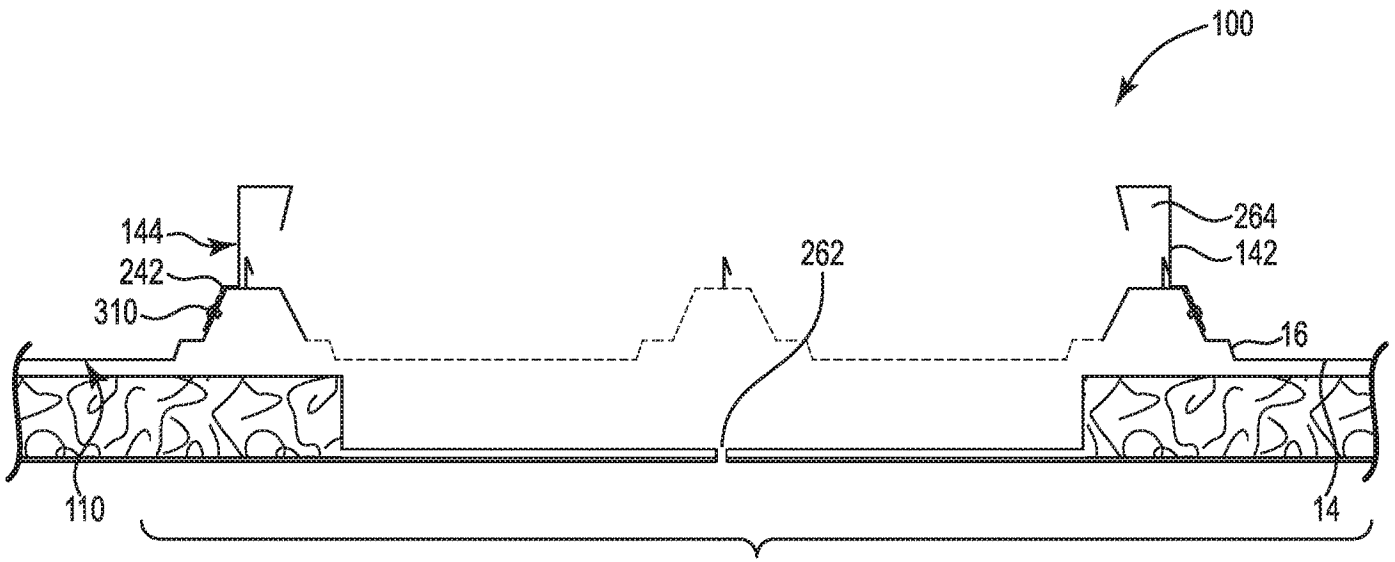
FIG. 8 shows a cross-section as in FIG. 6, after removal of that portion of the insulation batt material which was to be removed, and the insulation vapor barrier layer has been cut along the length of the aperture in the metal roof.

FIG. 8 shows the insulation batt material, marked with a dashed outline in FIG. 6, removed from its position under the central portion of the opening in the metal roof, removing almost all of the batt material from that portion of the facing sheet/vapor barrier layer. The vapor barrier layer is then cut, at an intermediate width, along the length of the roof-penetrating opening 249 over which the one or more skylight lenses are to be installed. At the ends of opening 249, the cut is spread in a "Y" shape to the corners of the opening, with the ends of the "Y" extending to approximately the up-slope corners of the opening.

Figure 9:
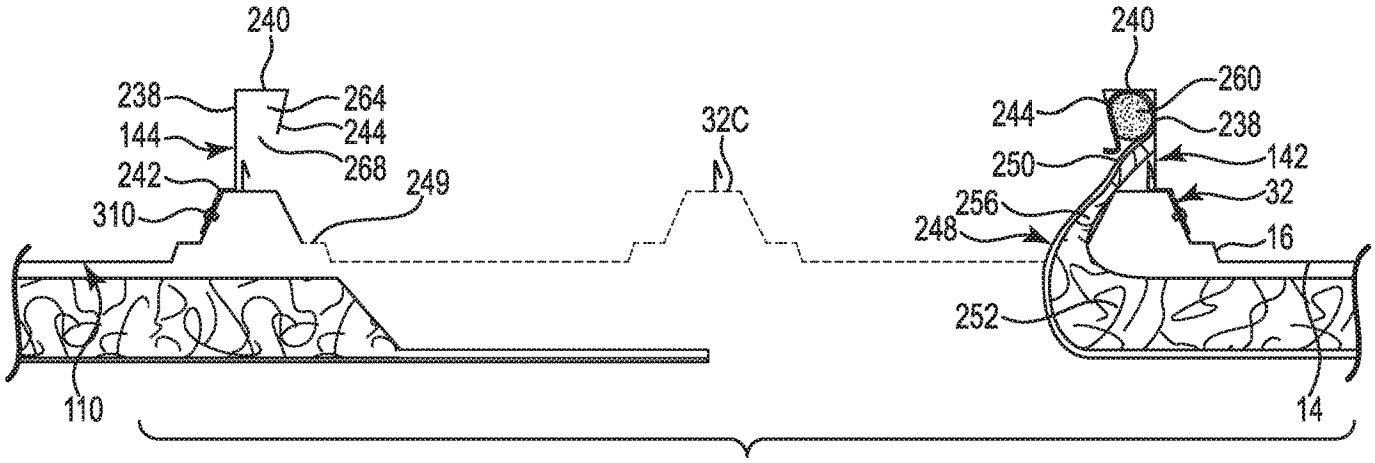
FIG. 9 shows a cross-section as in FIGS. 6 and 8 where the insulation vapor barrier layer on one side of the opening has been raised and tucked into the cavity in the rail, and is being held in the cavity by a retainer rod.

FIG. 9 shows one side of insulation 248 lifted up into the opening 249. The vapor barrier layer and edge portion 256 of the insulation batting have been lifted into the opening. A resilient foam retaining rod 260 has been forced into cavity 264 in the rail, with the vapor barrier layer captured between the retaining rod and the rail surfaces which define cavity 264. The insulation batting is simultaneously drawn up with the vapor barrier, and is generally trimmed from that portion of the vapor barrier which extends around retaining rod 260. Minor amounts of batt insulation material can be retained attached to the vapor barrier layer. As the vapor barrier layer is raised, an edge portion 256 of the batt material is drawn toward, and against, and into contact with, the respective rib 32. Vapor barrier layer 250 enters cavity 264 against upstanding outer web 238 of the rail, extends up and over/about rod 260 in the cavity, and thence extends back out of cavity 264 to a terminal end of the vapor barrier layer outside cavity 264. Any excess of the edge of the vapor barrier layer is trimmed off close to the cavity. Thus, rod 260 holds edge portion 256, as thermal insulation, against rib 32, and also positions the vapor barrier layer between the climate-controlled space 266 inside the building and the perimeter of the support structure.

As illustrated, the uncompressed, rest cross-section of rod 260 in cavity 264 is somewhat greater than the slot-shaped opening 268 between inside panel 244 and upstanding outer web 238. Thus retaining rod 260 is deformable, and the cross-section of the rod is compressed as the rod is being forced through opening 268. After passing through opening 268, rod 260 expands against web 238, upper flange 240, and panel 244 of the cavity while remaining sufficiently compressed to urge vapor barrier layer 250 against web 238, upper flange 240, and panel 244 of the cavity whereby vapor barrier layer 250 is assuredly retained in cavity 264 over the entire length of the rail or rails. A highly resilient, yet firm, polypropylene or ethylene propylene copolymer foam is suitable for rod 260. A suitable such rod, known as a "backer rod" is available from Bay Industries, Green Bay, Wis. Such backer rod can be manually compressed sufficiently to effect the insertion of the foam through opening 268 and into cavity 264.

To install the rod in cavity 264, the installer deflects panel 244 progressively along the length of slot opening 268 while correspondingly inserting respective progressive portions of the length of rod 260 into the cavity or compresses the rod while correspondingly inserting the progressive portion of the length of the rod into the cavity, or both compresses the rod and deflects panel 244 while inserting the progressive length of the rod into the cavity. As the installer releases a respective portion of inside panel 244 or rod 260, in the process of inserting a respective portion of the rod 260 into the cavity, the respective cavity structure or rod resiliently returns toward its rest position, closing slot 268 and/or expanding the rod to its rest position, which brings inside panel 244 into a holding engagement with the rod whereby the force being exerted between rod 260 and panel 244 in attempting to return to respective unstressed configurations applies an effective frictional holding force against vapor barrier 250.

Upper diverter 146 and lower closure 150 extend across the metal roof panels adjacent the upper and lower ends of roof opening 249 (FIGS. 4, 11, and 19), including across the first and second panel flats and across the middle rib, to complete the closure of support structure 100 about the perimeter of the skylight opening. The upper diverter and the lower closure have upper support structures 237 (FIG. 11) having cross-sections corresponding to the cross-sections of upper support structures 236 (FIG. 6) of rails 142, 144. Those upper support structures 237 thus have corresponding flange cavities which can be used to capture vapor barrier layer 250 at the upper diverter and the lower closure. Thus, the vapor barrier layer can be trapped by frictional engagement in a cavity at the upper reaches of the rail and closure structure about the entire perimeter of the rail and closure structure.

Bridging tape or the like is used to bridge between the side portions and end portions of insulation vapor barrier layer 250 at the "Y" cuts at the ends of rail and closure structure 140, such that the vapor barrier layer and tape, collectively, completely separate the interior of skylight cavity 274 from the respective elements of rail and closure structure 140 other than inside panel 244.

FIG. 10 shows vapor barrier layer 250 trapped/held in the rail cavities on both sides of the roof opening. FIG. 10 further shows the skylight subassembly, including frame 132 and lens 134, mounted to rails 142, 144, covering opening 249, and completing the closure of support structure 100 over and about opening 249. A series of fasteners 300 extend through skylight frame 132, through upstanding outer web 238 of the rail, and terminate in rod 260, whereby rod 260 insulates the inside of the roof opening from the temperature differential, especially cold, transmitted by fasteners 300, thereby to avoid fasteners 300 being a source of condensation inside the skylight cavity 274, namely below the skylight lens.

The standing seam panel roof 110, particularly the elevated ribs 32, supports the rail and closure structure, providing the structural support at the standing seams. The rail and closure structure cooperates with the structural profiles of the roof panels of the metal roof structure, including paralleling the rib elevations in the respective roof panels, whereby the rib elevations provide the primary support for the loads bearing down on the roof panels. Accordingly, the support structures of the invention adopt various ones of the advantages of a standing seam roof, including the beam strength features of the ribs at and adjacent the standing seams, as well as the water flow control features of the standing seam.

Most standing seam roofs are seamed using various clip assemblies supported from the roof purlins, which allow the roof panels to float/move relative to each other, along the major elevations, namely along the joinders between the respective roof panels, such joinders being defined at, for example, elevated ribs 32. By accommodating such movement of the panels relative to each other, the roof panels are free to expand and contract according to e.g. ambient temperature changes relative to any concurrent expansion or contraction of others of the roof panels.

As seen in FIG. 10, skylight frame 132 is secured to rail and closure structure 140 at side rails 142 and 144 by the series of fasteners 300 spaced along the length of the skylight frame, and rails 142 and 144 are secured to ribs 32 by a series of fasteners 310 spaced along the lengths of the respective rails.

A support structure of the invention, and a corresponding e.g. skylight assembly load, spans at least first and second next adjacent ones of the metal roof panels. As illustrated in e.g. FIGS. 4, 6, 9, and 10, side rails 142 and 144 are mounted to, and are supported from, ribs 32A and 32B. However, the support structure 100 is at least two roof panels wide, for a nominal width of e.g. 48 inches. Thus, the support structure, and its supported load, also extends across intervening middle rib 32C.

In the process of installing a skylight system of the invention, a short length of rib 32A, for example a two-inch length, is cut away, forming the first gap 122A in rib 32A. Similarly, an e.g. two-inch length of rib 32B is cut away, forming the second gap 122B in rib 32B.

In addition, the full length of middle rib 32C is removed, from the up-slope end of opening 249 in the roof, to the down-slope end of the opening.

In the retained portions of ribs 32A and 32B, namely along the full length of the skylight as disposed along the length of the respective roof panel, the standing seams 18, in combination with the top panel 241 of the rib, provide structural support characteristics which resemble the structural characteristics of the web and lower flange of an ,-beam. Thus, the standing seams, in combination with the other upstanding portions of ribs 32A, 32B, support side rails 142 and 144 while maintaining the conventional watertight seal at the joinders between roofing panels, along the length of the assembly. Stiffener plates 148 provide support, under the ribs, across gaps 122A, 122B.

Lower flange 410 of diverter 146 runs along, parallel to, and in general contact with, panel flat 14 of the respective roof panel. Fastener holes 430, illustrated in FIG. 11, are spaced along the length of lower flange 410 and extend through lower flange 410 for securing the lower flange to respective stiffener plates 148 in the panel flat, with the roof panel trapped between the lower flange and the respective stiffener plate.

Stiffener plates 148 are illustrated in FIGS. 5, and 12-19, and extend along the width dimension of the respective roof panels. A stiffener plate 148 is placed against the bottom surface of the respective roof panel at or adjacent the upper end of the opening in the roof. Self-drilling fasteners, such as screws 432, illustrated in FIG. 11, are driven through lower flange 410 of the upper diverter, through the metal roof panel and into stiffener plate 148, drawing the diverter, the roof panel, and the stiffener plate into facing contact with each other and thus trapping the panel flat of the roof panel between the stiffener plate and the diverter and closing/sealing the interface between the roof panel and the diverter. Thus, stiffener plate 148 acts as a nut for tightening fasteners 432. In the alternative, nut/bolt combinations, rivets, or other conventional fasteners, can be used in place of screws 432. Caulk or other sealant can be used to further reinforce the closure/sealing of the diverter/roof panel interface.

A stiffener plate 148 can also be used to provide lateral support, connecting respective ones of ribs 32 to each other. A stiffener plate 148 is typically steel or other material sufficiently rigid to provide a rigid support to the rail and closure structure at diverter 146 and to transfer the ,-beam strength characteristics of the standing seam across gaps 122 between the respective lengths of the standing seam.

Looking now to FIGS. 4, 11, 15-16, and 18, upper diverter 146 extends between rails 142, 144, and provides end closure as an upper closure member, and a weather tight seal, of the rail and closure structure, at the upper end of the roof opening/aperture, and diverts water around the upper end of the opening/aperture, to the panel flat portion 14 of an adjacent panel. The upstream ends of side rails 142 and 144 abut the downstream side of diverter 146, and the height of diverter 146 closely matches the heights of the side rails. Upper flange 400 of diverter 146 thus acts with upper flanges 240 of side rails 142 and 144, and an upper surface of lower closure 150, to form the upper surface of the rail and closure structure, to which the skylight lens frame 132 is mounted, such upper surface surrounding the space which extends upwardly from the corresponding opening in the roof.

As illustrated, end panel 412 has a diversion surface 420, namely first and second respectively left and right diversion surface elements 420A and 420B. A diversion surface element 420A or 420B is, without limitation, typically a flat surface, and end panel 412 defines first and second obtuse angles with lower flange 410 and with an upper web 415 of end panel 412. A given diversion surface element 420A or 420B has a relatively greater width against the middle rib 32C, and a relatively lesser width, approaching a nil dimension, along lateral leg 147 as extending through a rib gap 122A or 122B, thus to divert water toward and through the respective gap.

A diversion surface element 420A, 420B can, in the alternative, be either concave or convex whereby the central portion of the width of the respective diversion surface is recessed or protruding, relative to a plane axis extending across the width of the respective roof panel and along the lengths of the lines which represent the joint between the respective diversion surface and upper web 415, and the joint between the respective diversion surface and the lower flange, while the top and bottom edges of the diversion surface, namely at the respective joints, are typically, though not necessarily, represented by straight lines.

Figure 16:
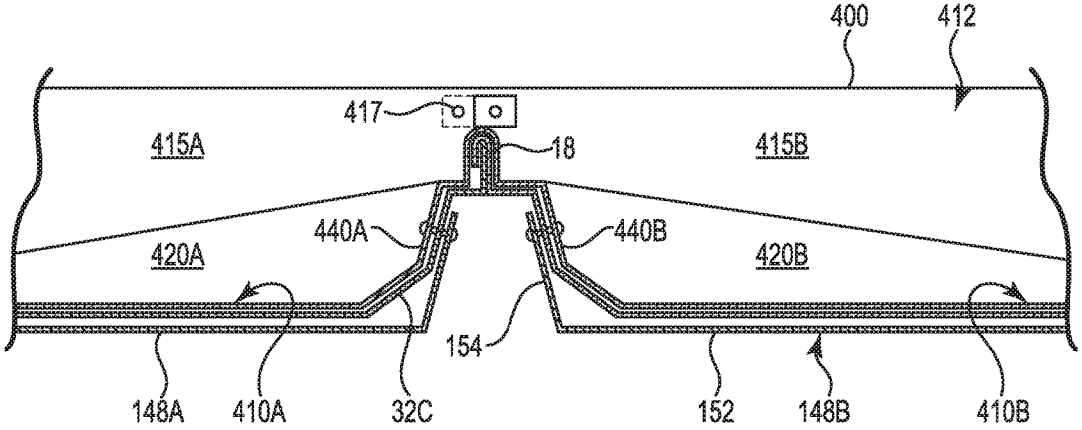
FIG. 16 is an enlarged view of the central portion of the upper diverter of FIG. 15.

Referring to FIG. 16, at the end of a lower flange element 410A, 410B, which is closer to the middle rib, is a respective rib mating structure 440A or 440B. The rib mating structure, e.g. 440A, is defined by a plurality of surfaces which collectively and generally conform the rib mating structure to the profile of middle rib 32C. Thus, the structure 440A or 440B has a plurality of surfaces which parallel corresponding surfaces of the respective rib.

At the end of lower flange 410 which is closer to a cut rib is a rib sealing portion 450 of upper web 415, which functions as an end closure of the respective cut rib 32A or 32B on the lower side of the respective gap 122A or 122B.

Rib sealing portion 450 further functions to divert water across the respective gap, through the respective rib 32, and onto the panel flat 14 of the adjacent roof panel. The respective rib sealing portion 450 extends through the respective gap 122 and across the respective otherwise-open end of the rib, thus closing off access to the otherwise-open, down-slope end of the rib. Hard rubber rib plugs 460, along with suitable tape mastic and caulk or other sealants, are inserted into the cut ends of the rib on both the upstream side and the downstream side of each gap 122. The upstream-side plug, plus tube sealants, serve as the primary barrier to water entry on the upstream side of the gaps 122. Rib sealing portion 450 of the upper web covers the rib plug 460 on the down-slope side of gap 122, and serves as the primary barrier to water entry on the downstream side of the respective gap 122, with plug 460, in combination with the tube sealant, serving as a back-up barrier.

The cross-sectional profiles of plugs 460 approximate the cross-sectional profiles of the cavities inside the respective ribs 32. Thus plugs 460, when coated with tape mastic and tube caulk, provide a water-tight closure in the upstream side of the cut rib, and a back-up water-tight closure in the downstream side of the cut rib. Accordingly, water which approaches upper diverter 146, from up-slope on the roof, is diverted by diversion surface element 420A or diversion surface element 420B and flange 410A or 410B and secondarily by web 415, toward the respective sealing portion 450, thence through a gap 122 in the respective rib, away from the high end of closure support structure 100 and onto the panel flat of the next laterally adjacent roof panel. Accordingly, so long as the flow channels through gaps 122 remain open, water which approaches the skylight assembly from above upper diverter 146 is directed to gaps 122, and flows through gaps 122, and away from, and around, the respective skylight assembly.

As illustrated in e.g. FIG. 11, lateral legs 147 of lower flanges 410A, 410B extend through gaps 122 on the ends of the upper diverter, at the right and left sides of the support structure, as viewed from up-slope of the diverter. Rib mating surfaces 440A, 440B of lower flanges 410A, 410B engage middle rib 32C at the middle of the diverter.

As illustrated, diverter 146 is typically assembled from left and right diverter elements, which are near mirror images of each other. Thus, each diverter element has a lateral leg 147 which extends through a gap 122 in a rib at the respective end of the diverter.

Upstanding outer web 415 of a first one of the diverter elements e.g. 146A includes a tab 416 which extends beyond the edge of the second diverter element. End panel 412 extends from the rib mating surface 440A or 440B to the respective gap 122; and a corresponding diversion surface extends from the lower flange to the respective upstanding outer web 415A or 415B.

Turning again to FIGS. 15-16, each diverter element has a mating surface 440A or 440B which overlies the respective side of middle rib 32C adjacent the up-slope end of opening 249. A such mating surface e.g. 440A extends up alongside rib 32C, including alongside the standing seam and stops at the top of the standing seam. The other of the mating surfaces, e.g. 440B extends up alongside the opposing side of the standing seam and thence laterally over the top of the standing seam, to and over the top of the other mating surface e.g. 440A, thus closing off the joinder of diverter elements 146A and 146B. In some embodiments, the second mating surface extends across the top of, and down alongside, the first mating surface.

Upstanding outer web 415 of a first one of the diverter elements e.g. 146A includes a tab 416 which extends beyond the edge of the second diverter element e.g. 146B. A mechanical fastener such as a rivet or screw 417 is then used to secure the tab to the second diverter element, thus tying the diverter elements to each other.

In some embodiments, and as illustrated in FIGS. 15-16, each of the diverter elements has a tab 416 which overlies the abutting edge of the other diverter element at middle rib 32C, and each tab is fastened to the opposing diverter element as shown in FIGS. 15 and 16.

Referring to FIGS. 12-18, stiffener plate 148 is defined by first and second stiffener plate elements 148A, 148B. Each stiffener plate element has a lower flange 152, a rib flange 154, and an upstanding end flange 156. As illustrated in FIG. 15, the rib flange 154 extends up into the lower cavity defined by rib 32C and is fastened to the rib lower shoulder by a rivet or screw 158. End flange 156 is positioned beyond end panel 412 of the respective upper diverter element such that the end flange is between the roof opening and end panel 412. As desired, the insulation 248 which is lifted up into the roof opening adjacent the upper diverter can be anchored to end flange 156.

The end of the stiffener plate element which is opposite rib 32C extends under the respective rib gap 122 and under a portion of the panel flat 14 of the next adjacent roof panel. One or more, e.g. two, rivets extend through the overlying lower flange of the respective diverter element, through the roof panel, and through the stiffener plate element, thus drawing the lower flange of the diverter element tight against the panel flats of the respective roof panels, and limiting any opening between the lower flange and the stiffener plate across the respective rib gap.

Figure 12:
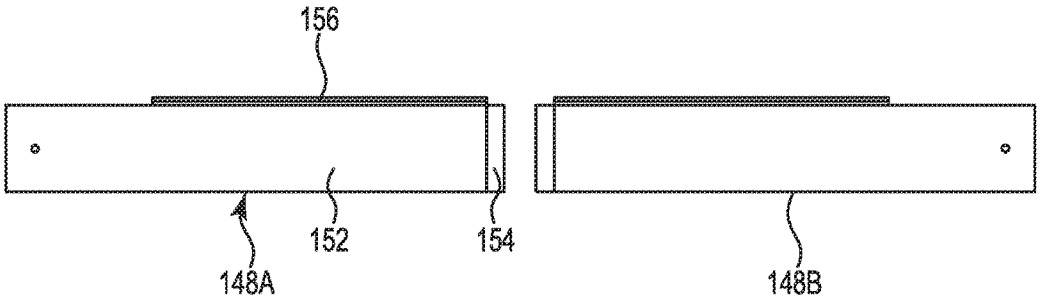
FIG. 12 shows a plan view of first and second stiffener plates which are used under panel flats of respective first and second roof panels which underlie the lower flanges of the upper diverter elements.
Figure 13:
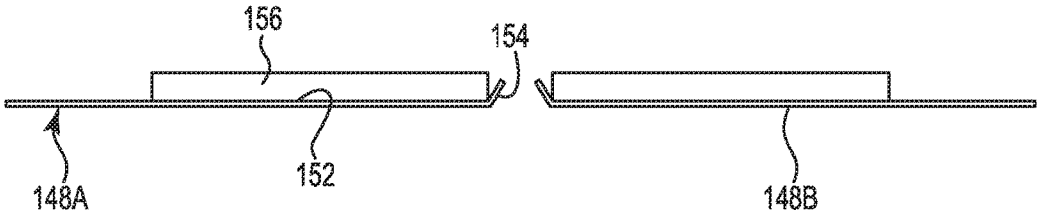
FIG. 13 shows an elevation view of the stiffener plates of FIG. 12, looking in a down-slope direction.
Figure 14:
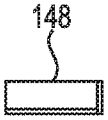
FIG. 14 is an end elevation view of the right stiffener plate of FIGS. 12 and 13.

Referring to FIGS. 12 and 13, the left and right stiffener plates are mirror images of each other.

Figure 17:
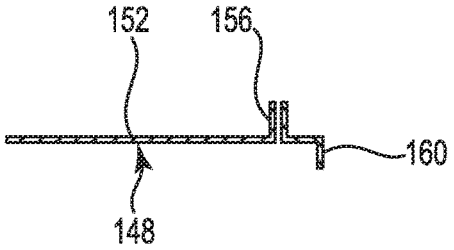
FIG. 17 is a cross-section of an elevation view of a stiffener plate of FIGS. 12-14, in combination with a stiffener tie which can be used to extend across the space between the first and second stiffener plates.

FIG. 17 illustrates an optional embodiment of the stiffener plate 148 which adds a stiffener tie 160 which is screwed or riveted to both of stiffener plates 148A 148B, thus to provide a tie which extends width-wise across the opening between plates 148A and 148B at middle rib 32C; and which optionally extends from proximate rib 32A to proximate rib 32B, and is periodically/intermittently secured/riveted to both stiffener plate elements along substantially the full width of diverter 146 between ribs 32A and 32B, thereby joining stiffener plates 148A and 148B to each other to make a single unitary stiffener plate 148.

Figure 18:
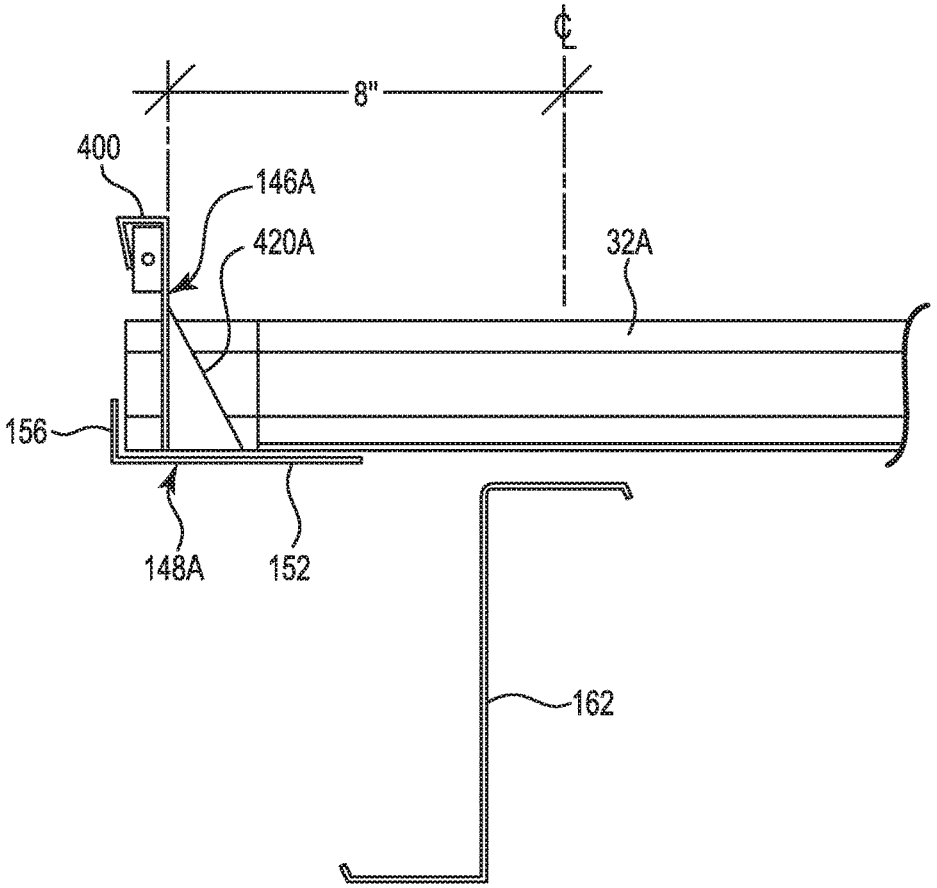
FIG. 18 is a side elevation view of an upper diverter assembly as in FIG. 11, showing longitudinal, e.g. up-slope, spacing of the upper diverter and the respective skylight aperture from the up-slope purlin which provides support for the cantilevered rib which supports the central portions of the upper diverter.

FIG. 18 is a side elevation view along the length of diverter element 146A, showing diverter element 146A, including diversion surface element 420A, and stiffener plate 148A, including upstanding end flange 156. FIG. 18 further shows the up-slope, down-slope relationship between the diverter and the purlin 162 which is immediately up-slope of the diverter and which provides the cantilevered support for the middle rib 32C.

Figure 19:
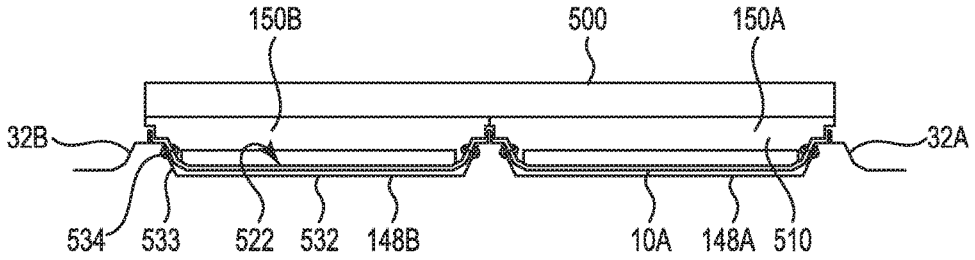
FIG. 19 is an end elevation view, looking in an up-slope direction, of a lower closure assembly of the invention mounted on a standing seam metal roof.
Figure 20:
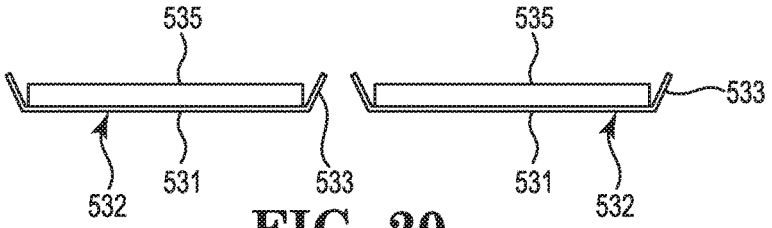
FIG. 20 is an elevation view of stiffener plates used in the lower closure assembly of FIG. 19.
Figure 21:
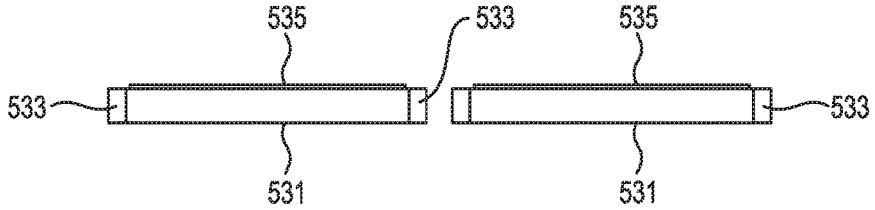
FIG. 21 is a plan view of the stiffener plates of FIG. 20.

FIGS. 19-24 show the closure of the support structure at the down-slope end of the support structure. Similar to the upper diverter, the closure of the support structure at the lower end of the opening has respective left and right elements which connect generally to middle rib 32C. The lower closure is used to establish and maintain a weather tight seal at the lower end of rail and closure structure 140, namely at the lower end of roof opening 249. As illustrated in FIG. 19, first ends of the bottoms of lower closure elements 150A, 150B are contoured to follow the profiles of ribs 32A, 32B, and the opposing ends of the bottoms of the closure elements are contoured to follow the profiles of the left and right sides of rib 32C. Between the ends of the lower closure elements 150A, 150B, the bottoms of the closures follow the profile of the respective panel flats 14 on either side of rib 32C across the widths of the respective panels between the respective ribs. The ends of the lower closure elements which are adjacent the side rails abut the lower ends of the respective side rails 142 and 144. The heights of lower closure elements 150A, 150B match the heights of side rails 142, 144.

Figure 24:
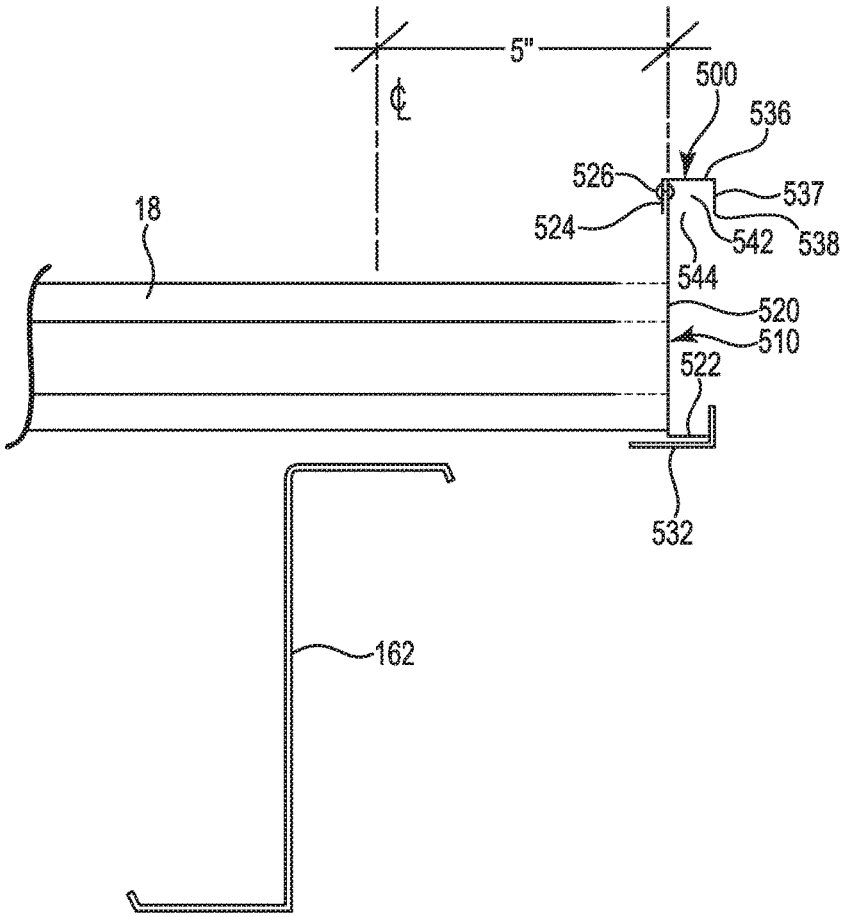
FIG. 24 is an elevation view of a lower closure assembly as in FIGS. 19 and 23, again showing the longitudinal, e.g. up-slope, spacing of the lower closure and the respective skylight aperture from the down-slope purlin which provides support for the cantilevered rib which supports the central portions of the lower closure.

Referring to FIGS. 19 and 24, each lower closure element has a bottom portion 510, and an upper cap 500 secured to the bottom portion by e.g. rivets or screws. Bottom portion 510 has a lower flange 522, as well as a closure web 520. Lower flange 522 is in-turned, that is, the flange 522 extends inwardly of closure web 520 toward the roof opening, and may include fastener holes.

A stiff, e.g. steel, stiffener plate element 532 extends the width of each panel flat under the lower flange 522 of the lower portion of each lower closure element. Each stiffener plate element has a lower flange 531, first and second stiffener legs 533 extending upwardly from the lower flange at the opposing ends of stiffener plate element 532, matching the profile of at least one upwardly-extending panel of the respective rib 32 so as to be in surface-to-surface relationship with the respective upwardly-extending rib panel and an upstanding end flange 535. Self-drilling screws 534 or rivets extend through the profile-matching portion of the lower flange of the lower closure, through holes 530, through the respective facing portion of the roof panel, and into the lower flange of the respective stiffener plate element. Stiffener plate 532 acts as a nut for the respective screws/rivets 534, whereby the screws/rivets can firmly secure the lower flange of bottom portion 510 to the roof panel, both in the panel flat and at upstanding portions of the ribs, providing stiffening support to the securement of the lower closure to the roof panel. Tube sealants can be used to enhance such closure.

Similar stiffener legs 533 extend upwardly at rib 32C and respective screws/rivets extend through the profile-matching portion of the lower flange of the lower closure, through holes in the rib, and through holes in legs 533, thus to secure legs 533 and the overlying lower closure element to rib 32C.

Figure 22:
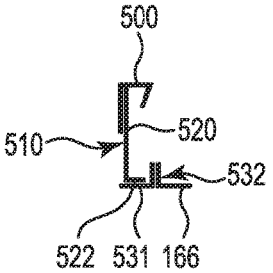
FIG. 22 is a side elevation view showing positioning of the stiffener plate relative to the 2-piece lower closure used in the lower closure assembly of FIG. 19.
Figure 23:
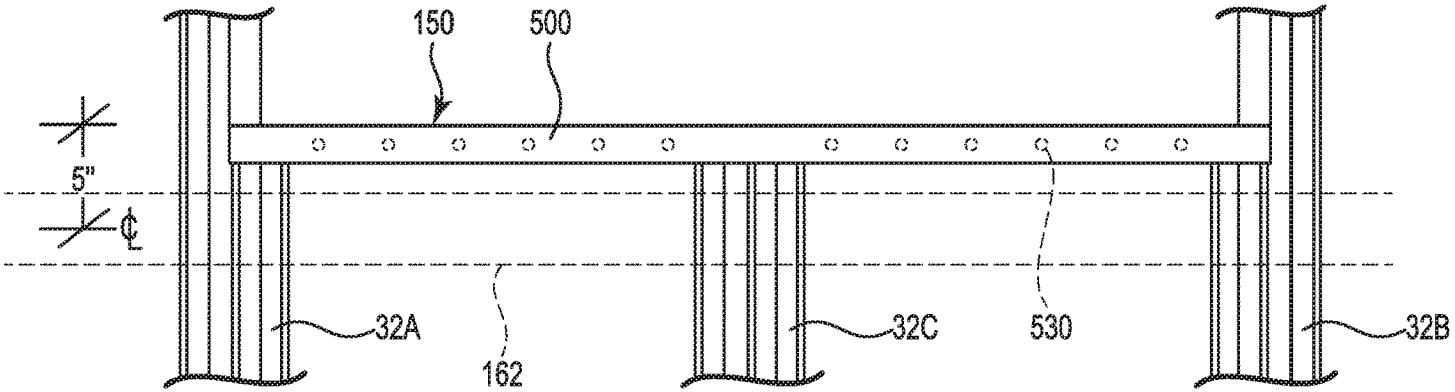
FIG. 23 is a plan view of the lower closure assembly of FIG. 19 in combination with the ends of first and second side rails, all being used as part of a support structure of the invention, and showing longitudinal, e.g. up-slope, spacing of the lower closure and the respective skylight aperture from the down-slope purlin which provides support for the cantilevered rib which supports the central portions of the lower closure.

As at the upper diverter, a stiffener tie 166 can be used to tie the stiffener plate portions 532 to each other. The stiffener tie can be a simple 90 degree angle bracket as shown in FIG. 22, or can be e.g. a z-shaped bracket as illustrated in FIG. 17.

Upper cap 500 is an elongate inverted, generally U-shaped structure, and typically extends, as a single unit, across the full width of the support structure from proximate rib 32A to proximate rib 32B, although cap 500 can be two pieces if desired. A first downwardly-extending leg 524 has a series of apertures spaced along the length of the cap. Screws 526 or other fasteners extend through leg 524 and through closure web 520, thus mounting cap 500 to bottom portion 510 of the lower closure.

Cap 500 extends, generally horizontally, from leg 524 inwardly and across the top of closure web 520, along upper flange 536 to inside panel 537. Inside panel 537 extends down from upper flange 536 at an included angle, between upper flange 536 and inside panel 537, of about 75 degrees, to a lower edge 538 of the inside panel.

Thus, the upper cap of the lower closure, in combination with the upper region of closure web 520, defines a cavity 542 which has a cavity cross-section corresponding with the cross-sections of cavities 264 of rails 142, 144. As with cavities 264 of the side rails, foam retaining rod 260 is compressed in order to force the rod through slot 544, capturing vapor barrier layer 250 between the retaining rod and the surfaces which define cavity 542. The vapor barrier layer is lifted into opening 249 in the roof. Vapor barrier layer 250 traverses cavity 542 along a path similar to the path through cavities 264. Thus, vapor barrier layer 250 enters cavity 542 against the inner surface of closure web 520, extends up and over/about rod 260 in the cavity, against upper flange 536 and inside panel 537, and back out of cavity 542 to a terminal end of the vapor barrier layer outside cavity 542. The tension on vapor barrier layer 250 holds edge portion 256 of the batting against bottom portion 510 of the lower closure.

In the alternative, the insulation, including the vapor barrier layer if desired, can be mounted to the upstanding webs of stiffener tie 166.

Support structures of the invention are particularly useful for continuous runs of e.g. skylights, where individual skylights are arranged end to end between the ridge and the eave of a roof. The ends of two rails can be joined to each other end to end by connectors now known in the art, in a strip of such skylight assemblies.

The standing rib elevations underlie, and are in continuous supporting contact with, the side rails, providing continuous underlying support to the rails along the entireties of the lengths of the rails, and respectively along the entireties of the lengths of the skylight assemblies.

In the process of installing the closure support structure, the upper diverter is installed first, after cutting a small portion of opening 249 near the diverter location. Then, after the upper diverter is installed, the remainder of the roof opening is cut in the respective roof panel and the rails are installed. The lower closure is then installed, which completes the process of defining the perimeter bearing surfaces for the support structure, which are to support the perimeter of the collective set of skylight assemblies which overlie opening 249. Insulation 248, as appropriate, is then drawn up through the opening and secured in the cavities in the rails, in the diverter, and in the lower closure. The skylight assemblies are then mounted on the respective bearing surfaces and the ends of the respective skylight assemblies are joined to each other; and the skylight assemblies are secured to the rails. Tube sealant and tape mastic are applied, as appropriate, at the respective stages of the process to achieve leak-free joinders between the respective elements of the closure assembly.

Skylight assemblies of the invention can be connected end to end for as long a distance as necessary, using connecting brackets, to completely cover/overlie a roof opening, as each skylight assembly unit is supported by the ribs 32 of the respective roof panel through respective rails 142, 144. The full collective lengths of the respective rails, regardless of the number of skylight assemblies which are used to close off a given opening in the roof, can extend longitudinally along respective standing rib elevations. And except for the skylight assemblies on either end of a run of skylights, the entirety of the weight of the skylight assembly passes through the respective rib and thence to the underlying building support structure. Minor portions of the weight of the skylight assembly may pass through the panel flat, or the middle rib 32C at the upper and lower ends of the rail and closure structure.

In support structures of the invention, the 2-way upper diverter diverts water in opposing lateral directions through first and second rib gaps 122A, 122B, through both of the ribs to which the rails are mounted, and onto the roof panels on both sides of the support structure.

Each diversion panel stands generally upright while, without limitation, defining a first obtuse angle with lower flange 410 and a second obtuse angle with upper web 415, whereby an imaginary extension of upper web 415 defines a generally perpendicular angle with lower flange 410. As illustrated, diversion panels extend as diversion surface elements 420A, 420B to respective sides of middle rib 32C. Lateral legs 147 of the respective diversion panels extend through the rib gaps, extending onto, and over, the panel flats of the next adjacent roof panels.

The stiffener plates at the upper diverter and lower closure provide both vertical support and lateral support at both the up-slope end and the down-slope end of the support structure. Still further, the stiffener plates provide foundations for drawing together the lower flanges of the diverter elements and the lower closure elements, with the respective roof panels, thus to close off the joints between the lower flanges and the roof panels. The lower flanges and roof panels are sufficiently tightly drawn to each other that a waterproof seal is provided, including use of tube sealant as needed, preventing water leakage into the enclosed space at the opening, or directly into the building, at the lower flanges of the upper diverter and lower closure.

While both upper diverter 146 and lower closure 150 have been illustrated as being defined by first and second, left and right elements, both the upper diverter and the lower closure can be fabricated off the construction site as a single piece; or can be brought to the construction site and welded on site after having been installed over/adjacent the roof opening. In such case, especially with respect to the upper diverter, tabs 416 may, in some embodiments, be omitted.

Now addressing all of the embodiments illustrated, the weight of a load received on rails 142, 144 is transferred directly from the rails, to ribs 32A, 32B of the respective underlying roof panels, optionally along the full length of the support structure; and only a minor portion, such as less than 10%, if any, of that weight is borne by the panel flats, and only at the upper and lower ends of the support structure. Thus, the weight conveyed by the rails, or conveyed by the rail and closure structure, is borne by those elements of the roof panels which are most capable of bearing weight without substantial deflection of the roof panels under load, namely most, if not all, of the weight is carried by the ribs.

The primary reason why the disclosed rail and closure structures can surround an opening without water leakage is that a great portion of the perimeter of the support structure, namely that which is defined by side rails 142, 144, is above the panel flat, namely above the normal high water line on the roof panel; and all associated roof penetrations, such as screws 310 which mount the rails to the ribs, are above that normal high water line. With little or no standing water at the joinders between the rails and the roof panels, or at any fasteners, even if the sealant fails at a joinder, no substantial quantity of water routinely enters such failed joinder because of the heights of such joinders above that normal high water line.

Rail and closure structures of the invention close off a roof opening from unplanned leakage of e.g. air or water through such roof opening. The rail and closure structure 140 extends about the perimeter/sides of the roof opening and extends from the roofing panels upwardly to the top opening in the rail and closure structure. A closure member, e.g. skylight subassembly, overlies the top opening in the rail and closure structure and thus closes off the top opening to complete the closure of the roof opening.

Support structure 100 thus is defined at least in part by rail and closure structure 140 about the perimeter of the roof opening, and the closure member, such as skylight assembly 130, or the like, overlies the top of the rail closure structure and thus closes off the top of the closure support structure over the roof opening.

Rail and closure structure 140 has been illustrated in detail with respect to one or more variations of the standing seam roofs illustrated in FIGS. 1, 2, and 3. In light of such illustrations, those of skill in the art can now adapt the illustrated rail and closure structures, by modifying, shaping of the structure elements, to support loads from any roof system which has a profile which includes elevations, above the panel flat, using standing joinders or other raised elevations as the locus of attachment to the roof.

Although the invention has been described with respect to various embodiments, this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A load support structure configured to support an overlying load on a sloping metal panel roof defined by a plurality of elongate metal roof panels, elongate upstanding rib elements being defined on opposing sides of the roof panels, with panel flats between the upstanding rib elements, the upstanding rib elements on next adjacent ones of the roof panels being joined to each other to form upstanding ribs on the opposing sides of the respective roof panels, the elongate upstanding ribs extending from an eave to a ridge of such roof, said load support structure comprising:

(a) first and second rails adapted and configured to be mounted on first and second ones of the upstanding ribs, with a third one of the ribs being disposed between the first and second ribs, and wherein entireties of the panel flats of first and second ones of the elongate roof panels are disposed between the first and second rails, said first and second rails each having an up-slope end and a down-slope end when mounted on the first and second ones of the upstanding ribs;

(b) an upper diverter having opposing left and right sides, an up-slope end and a down-slope end, said upper diverter comprising (i) a lower flange having a first left end disposed toward the left side of said upper diverter, and a first right end disposed toward the right side of said upper diverter, and a first length extending in a first direction between the first left end and the first right end, (ii) an upstanding end panel having an upper edge and a lower edge, a second left end corresponding to the first left end of said lower flange, and an opposing second right end corresponding to the first right end of said lower flange, and a second length between the second left end and the second right end and extending in generally the first direction, said end panel comprising A. an upper web having a third length extending in generally the same direction as the first and second lengths, between left and right ends of said upper web, said upper web further having an upper web upper edge and an upper web lower edge, and B. left and right diversion panels defining left and right diversion surfaces extending upwardly from said lower flange and being joined with said upper web, said lower flange comprising (i) a first lower flange member having a first lower flange member end at the first left end of said lower flange, and (ii) a second lower flange member having a second lower flange member end at the first right end of said lower flange, said first and second lower flange members of said lower flange extending generally in a common plane from the first lower flange member end to the second lower flange member end, a mid-portion of said lower flange, between said first and second lower flange member ends, extending upwardly from the common plane, and (c) a lower closure adapted and configured to be mounted on the sloping metal panel roof and to extend between the first and second rails;

said lower flange further comprising a third lower flange member end opposing the first lower flange member end, and a fourth lower flange member end opposing the second lower flange member end, said third and fourth lower flange member ends defining first and second mating surfaces between said first and second lower flange member ends, which first and second mating surfaces extend upwardly from the common plane.

2. A load support structure as in claim 1, widths of the roof panels extending between opposing sides of the respective roof panels, said upper diverter being adapted and configured to extend across the widths of the first and second ones of the elongate roof panels, and to close off said load support structure from lateral entry at the up-slope end of said load support structure, said lower closure being adapted and configured to extend across the widths of the first and second ones of the elongate roof panels, and to close off said load support structure from lateral entry at the down-slope end of said load support structure.

3. A load support structure as in claim 1, said first and second lower flange members comprising first and second separate and distinct lower flange elements, the mid-portion of said lower flange comprising the third and fourth lower flange member ends, and wherein said third and fourth lower flange member ends meet when said load support structure is mounted on the metal panel roof.

4. A load support structure as in claim 3 wherein the third and fourth lower flange member ends interface with upstanding elements of the third rib.

5. A load support structure as in claim 3 wherein the third lower flange member end is spaced a first distance from the first lower flange member end, and the fourth lower flange member end is spaced a second distance from the second lower flange member end, and wherein the magnitude of the first distance equals the magnitude of the second distance.

6. A load support structure as in claim 3 wherein a portion of one of said first and second lower flange elements extends above the third rib.

7. A load support structure as in claim 1, wherein, when said load support structure is mounted on the metal panel roof, the third rib extends under said first and second mating surfaces.

8. A load support structure as in claim 7 wherein, when said load support structure is mounted on the metal panel roof, the third rib extends to said upper web of said upstanding end panel.

9. A load support structure as in claim 7 wherein the first and second mating surfaces overlap each other at the third rib.

10. A load support structure as in claim 1 wherein, when said load support structure is mounted on the metal panel roof, the third rib extends to said upper web of said upstanding end panel.

11. A load support structure as in claim 1 wherein said third and fourth lower flange member ends are equal distances from said first and second rails.

12. A sloping metal panel roof comprising a plurality of elongate metal roof panels, elongate upstanding rib elements being defined on opposing sides of said roof panels, with panel flats between the upstanding rib elements, said upstanding rib elements on next adjacent ones of said roof panels being joined to each other to form upstanding ribs on the opposing sides of respective said roof panels, said elongate upstanding ribs extending from an eave to a ridge of the roof, a load support structure as in claim 1 being mounted on said sloping metal roof.

13. A sloping metal roof as in claim 12, said load support structure further comprising a stiffener support structure under said lower flange and extending from said first rib to said second rib, a mid-portion of said stiffener support structure extending upwardly through the common plane of said first and second lower flange members, at the mid-portion of said lower flange.

14. A sloping metal roof as in claim 13, said stiffener structure comprising a first stiffener plate extending from the right side of said upper diverter under the first respective said roof panel and extending upwardly under said third rib, and a second stiffener plate extending from the left side of said upper diverter under the second respective said roof panel and extending upwardly under said third rib.

15. A sloping metal roof as in claim 14, further comprising a stiffener tie extending between, and secured to, both of said first and second stiffener plates, thereby to tie the first and second stiffener plates and the stiffener tie together to form a unitary stiffening structure adapted and configured to stiffen the combination of the respective roof panels and the load support structure, thereby providing stability to a load overlying said load support structure.

16. A load support structure as in claim 1 wherein the first and second mating surfaces overlie respective sides of the third rib.

17. A load support structure configured to support an overlying load on a sloping metal panel roof defined by a plurality of elongate metal roof panels, elongate upstanding rib elements being defined on opposing sides of the roof panels, with panel flats between the upstanding rib elements, the upstanding rib elements on next adjacent ones of the roof panels being joined to each other to form upstanding ribs on the opposing sides of the respective roof panels, the elongate upstanding ribs extending from an eave to a ridge of such roof, said load support structure comprising:

(a) first and second rails adapted and configured to be mounted on first and second ones of the upstanding ribs, with a third one of the ribs being disposed between the first and second ribs, and wherein entireties of the panel flats of first and second ones of the elongate roof panels are disposed between the first and second rails, said first and second rails each having an up-slope end and a down-slope end when mounted on the first and second ones of the upstanding ribs;

(b) an upper diverter having opposing left and right sides, said upper diverter comprising (i) a lower flange having a first left end disposed toward the left side of said upper diverter, and a first right end disposed toward the right side of said upper diverter, and a first length extending in a first direction between the first left end and the first right end, (ii) an upstanding end panel having an upper edge and a lower edge, a second left end corresponding to the first left end of said lower flange, and an opposing second right end corresponding to the first right end of said lower flange, and a second length between the second left end and the second right end and extending in generally the first direction, said end panel comprising A. an upper web having a third length extending in generally the same direction as the first and second lengths, between left and right ends of said upper web, said upper web further having an upper web upper edge and an upper web lower edge, and B. left and right diversion panels defining left and right diversion surfaces extending between, and being joined with, said lower flange and said upper web, said lower flange comprising a first lower flange member having a first lower flange member end at the first left end of said lower flange, and a second lower flange member having a second lower flange member end at the first right end of said lower flange, said first and second lower flange members extending generally in a common plane from the first lower flange member end to the second lower flange member end, a mid-portion of said lower flange extending upwardly from the common plane; and (c) a lower closure adapted and configured to be mounted on the sloping metal panel roof and to extend between the first and second rails, wherein said upper diverter comprises a first upper diverter element comprising said first lower flange member and a first upstanding end panel, and a second upper diverter element comprising said second lower flange member and a second upstanding end panel, and wherein said first and second upper diverter elements, when mounted on the metal panel roof, extend toward, and are joined to, each other.

18. A load support structure as in claim 17 wherein a portion of one of said first and second lower flange members overlaps the other of said first and second lower flange members.

19. A load support structure as in claim 17, a third lower flange member end opposing the first lower flange member end, a fourth lower flange member end opposing the second lower flange member end, and wherein, when said load support structure is mounted on the metal panel roof, the third and fourth lower flange member ends meet.

20. A load support structure as in claim 17, a third lower flange member end opposing the first lower flange member end, a fourth lower flange member end opposing the second lower flange member end, and wherein, when said load support structure is mounted on the metal panel roof, the third and fourth lower flange member ends interface with upstanding elements of the third rib.

21. A load support structure as in claim 17, a third lower flange member end opposing the first lower flange member end, a fourth lower flange member end opposing the second lower flange member end, and wherein, when said load support structure is mounted on the metal panel roof, the third rib extends under the third and fourth lower flange member ends.

22. A load support structure as in claim 21 wherein, when said load support structure is mounted on the metal panel roof, the third rib extends to said upper web of said upstanding end panel.

23. A sloping metal panel roof comprising a plurality of elongate metal roof panels, elongate upstanding rib elements being defined on opposing sides of said roof panels, with panel flats between the upstanding rib elements, said upstanding rib elements on next adjacent ones of said roof panels being joined to each other to form upstanding ribs on the opposing sides of respective said roof panels, said elongate upstanding ribs extending from an eave to a ridge of the roof, a load support structure as in claim 21 being mounted on said sloping metal roof.

24. A sloping metal panel roof comprising a plurality of elongate metal roof panels, elongate upstanding rib elements being defined on opposing sides of said roof panels, with panel flats between the upstanding rib elements, said upstanding rib elements on next adjacent ones of said roof panels being joined to each other to form upstanding ribs on the opposing sides of respective said roof panels, said elongate upstanding ribs extending from an eave to a ridge of the roof, a load support structure as in claim 17 being mounted on said sloping metal roof.

25. A load support structure configured to support an overlying load on a sloping metal panel roof defined by a plurality of elongate metal roof panels, elongate upstanding rib elements being defined on opposing sides of the roof panels, with panel flats between the upstanding rib elements, the upstanding rib elements on next adjacent ones of the roof panels being joined to each other to form upstanding ribs on the opposing sides of the respective roof panels, the elongate upstanding ribs extending from an eave to a ridge of such roof, said load support structure comprising:

(a) first and second rails adapted and configured to be mounted on first and second ones of the upstanding ribs, with a third one of the ribs being disposed between the first and second ribs, and wherein entireties of the panel flats of first and second ones of the elongate roof panels are disposed between the first and second rails, said first and second rails each having an up-slope end and a down-slope end when mounted on the first and second ones of the upstanding ribs;

(b) an upper diverter having opposing left and right sides, an up-slope end and a down-slope end, said upper diverter comprising (i) a lower flange having a first left end disposed toward the left side of said upper diverter, and a first right end disposed toward the right side of said upper diverter, and a first length extending in a first direction between the first left end and the first right end, (ii) an upstanding end panel having an upper edge and a lower edge, a second left end corresponding to the first left end of said lower flange, and an opposing second right end corresponding to the first right end of said lower flange, and a second length between the second left end and the second right end and extending in generally the first direction, said end panel comprising A. an upper web having a third length extending in generally the same direction as the first and second lengths, between left and right ends of said upper web, said upper web further having an upper web upper edge and an upper web lower edge, and B. left and right diversion panels defining left and right diversion surfaces extending upwardly from said lower flange and being joined with said upper web, said lower flange comprising (i) a first lower flange member having a first lower flange member end at the first left end of said lower flange, and (ii) a second lower flange member having a second lower flange member end at the first right end of said lower flange, said first and second lower flange members of said lower flange extending generally in a common plane from the first lower flange member end to the second lower flange member end, a mid-portion of said lower flange, between said first and second lower flange member ends, extending upwardly from the common plane, and (c) a lower closure adapted and configured to be mounted on the sloping metal panel roof and to extend between the first and second rails;

wherein said first and second lower flange members comprise first and second separate and distinct lower flange elements, the mid-portion of said lower flange comprising third and fourth lower flange member ends respectively opposing the first and second lower flange member ends, and wherein said third and fourth lower flange member ends meet when said load support structure is mounted on the metal panel roof; and wherein one of said third and fourth lower flange member ends extends over a top of the other of said third and fourth lower flange member ends.

26. A load support structure configured to support an overlying load on a sloping metal panel roof defined by a plurality of elongate metal roof panels, elongate upstanding rib elements being defined on opposing sides of the roof panels, with panel flats between the upstanding rib elements, the upstanding rib elements on next adjacent ones of the roof panels being Joined to each other to form upstanding ribs on the opposing sides of the respective roof panels, the elongate upstanding ribs extending from an eave to a ridge of such roof, said load support structure comprising:

(a) first and second rails adapted and configured to be mounted on first and second ones of the upstanding ribs, with a third one of the ribs being disposed between the first and second ribs, and wherein entireties of the panel flats of first and second ones of the elongate roof panels are disposed between the first and second rails, said first and second rails each having an up-slope end and a down-slope end when mounted on the first and second ones of the upstanding ribs;

(b) an upper diverter having opposing left and right sides, an up-slope end and a down-slope end, said upper diverter comprising (i) a lower flange having a first left end disposed toward the left side of said upper diverter, and a first right end disposed toward the right side of said upper diverter, and a first length extending in a first direction between the first left end and the first right end, (ii) an upstanding end panel having an upper edge and a lower edge, a second left end corresponding to the first left end of said lower flange, and an opposing second right end corresponding to the first right end of said lower flange, and a second length between the second left end and the second right end and extending in generally the first direction, said end panel comprising A. an upper web having a third length extending in generally the same direction as the first and second lengths, between left and right ends of said upper web, said upper web further having an upper web upper edge and an upper web lower edge, and B. left and right diversion panels defining left and right diversion surfaces extending upwardly from said lower flange and being joined with said upper web, said lower flange comprising (i) a first lower flange member having a first lower flange member end at the first left end of said lower flange, and (ii) a second lower flange member having a second lower flange member end at the first right end of said lower flange, said first and second lower flange members of said lower flange extending generally in a common plane from the first lower flange member end to the second lower flange member end, a mid-portion of said lower flange, between said first and second lower flange member ends, extending upwardly from the common plane, and (c) a lower closure adapted and configured to be mounted on the sloping metal panel roof and to extend between the first and second rails;

wherein said first and second lower flange members comprise first and second separate and distinct lower flange elements, the mid-portion of said lower flange comprising third and fourth lower flange member ends respectively opposing the first and second lower flange member ends, and wherein said third and fourth lower flange member ends meet when said load support structure is mounted on the metal panel roof;

wherein the third and fourth lower flange member ends interface with upstanding elements of the third rib; and wherein the third and fourth lower flange member ends extend up alongside the upstanding elements of the third rib.

27. A load support structure configured to support an overlying load on a sloping metal panel roof defined by a plurality of elongate metal roof panels, elongate upstanding rib elements being defined on opposing sides of the roof panels, with panel flats between the upstanding rib elements, the upstanding rib elements on next adjacent ones of the roof panels being joined to each other to form upstanding ribs on the opposing sides of the respective roof panels, the elongate upstanding ribs extending from an eave to a ridge of such roof, the load support structure comprising:

(a) first and second rails adapted and configured to be mounted on first and second ones of the upstanding ribs, with a third one of the ribs being disposed between the first and second ribs, and wherein entireties of the panel flats of first and second ones of the elongate roof panels are disposed between the first and second rails, the first and second rails each having an up-slope end and a down-slope end when mounted on the first and second ones of the upstanding ribs;

(b) an upper diverter having opposing left and right sides, an up-slope end, and a down-slope end, the upper diverter comprising (i) a lower flange having a first left end disposed toward the left side of the upper diverter, and a first right end disposed toward the right side of the upper diverter, and a first length extending in a first direction between the first left end and the first right end, (ii) an upstanding end panel having an upper edge and a lower edge, a second left end corresponding to the first left end of the lower flange, and an opposing second right end corresponding to the first right end of the lower flange, and a second length between the second left end and the second right end and extending in generally the first direction, the end panel comprising A. an upper web having a third length extending in generally the same direction as the first and second lengths, between left and right ends of the upper web, the upper web further having an upper web upper edge and an upper web lower edge, and B. left and right diversion panels defining left and right diversion surfaces extending upwardly from the lower flange and being joined with the upper web, the lower flange comprising a first and a second lower flange member, the first and second lower flange members having respective first and second lower flange member ends, the first and second lower flange members extending generally in a common plane from the first lower flange member end to the second lower flange member end, a mid-portion of the lower flange, between the first and second lower flange member ends, extending upwardly from the common plane, and (c) a lower closure adapted and configured to be mounted on the sloping metal panel roof and to extend between the first and second rails;

wherein the upper diverter has a central portion adapted to be supported by the third rib.

* * * * *